US005445230A

United States Patent [19]

Wattenburg et al.

[11] Patent Number: 5,445,230

[45] Date of Patent: Aug. 29, 1995

[54] DOWNHOLE DRILLING SUBASSEMBLY AND METHOD FOR SAME

[76] Inventors: Willard H. Wattenburg, 711 Parkwood Dr., Chico, Calif. 95928; Eric J. Wattenburg, 535 Oak Ave., Davis, Calif. 95616

[21] Appl. No.: 130,286

[22] Filed: Oct. 1, 1993

[51] Int. Cl.[6] ..... E21B 7/08

[52] U.S. Cl. ..... 175/74; 175/322

[58] Field of Search ..... 175/61, 62, 73, 74, 175/75, 322

[56] References Cited

U.S. PATENT DOCUMENTS

| | | | |
|---|---|---|---|
| Re. 29,526 | 1/1978 | Jeter | 175/73 |
| 2,891,769 | 6/1959 | Page, Sr. et al. . | |
| 2,971,582 | 2/1961 | Marsh . | |
| 3,043,381 | 7/1962 | McNeely, Jr. . | |
| 3,595,326 | 7/1971 | Claycomb . | |
| 3,627,356 | 12/1971 | Anderson | 175/61 |
| 3,797,576 | 3/1974 | Azalbert et al. . | |
| 4,046,204 | 9/1977 | Takaoka et al. | 175/76 |
| 4,225,000 | 9/1980 | Maurer | 175/107 |
| 4,246,976 | 1/1981 | McDonald, Jr. | 175/107 |
| 4,258,800 | 3/1981 | Hipp | 175/61 |
| 4,281,723 | 8/1981 | Edmond et al. | 175/76 |
| 4,291,773 | 9/1981 | Evans | 175/61 |
| 4,324,299 | 4/1982 | Nagel | 175/107 |
| 4,340,334 | 7/1982 | Nixon | 415/172 F |
| 4,485,879 | 12/1984 | Kamp et al. | 175/61 |
| 4,492,276 | 1/1985 | Kamp | 175/61 |
| 4,613,002 | 9/1986 | Pittman et al. | 175/107 |
| 4,638,873 | 1/1987 | Welborn | 175/73 |
| 4,653,598 | 3/1987 | Schuh et al. | 175/75 |
| 4,655,299 | 4/1987 | Schoeffler | 175/61 |
| 4,662,458 | 5/1987 | Ho | 175/27 |
| 4,665,997 | 5/1987 | Maurer et al. | 175/107 |
| 4,667,751 | 5/1987 | Geczy et al. | 175/61 |
| 4,697,651 | 10/1987 | Dellinger | 175/61 |
| 4,739,842 | 4/1988 | Kruger et al. | 175/61 |
| 4,745,982 | 5/1988 | Wenzel | 175/74 |
| 4,763,734 | 8/1988 | Dickinson et al. | 175/61 |
| 4,817,740 | 4/1989 | Beimgraben | 175/74 |
| 4,834,193 | 5/1989 | Leitko, Jr. et al. | 175/19 |
| 4,836,303 | 6/1989 | Boulet et al. | 175/74 |
| 4,880,066 | 11/1989 | Steiginga et al. | 175/75 |
| 4,880,067 | 11/1989 | Jelsma | 175/107 |
| 4,884,643 | 12/1989 | Wawrzynowski et al. | 175/74 |
| 4,895,214 | 1/1990 | Schoeffler | 175/38 |
| 4,932,482 | 6/1990 | DeLucia | 175/75 |
| 4,957,173 | 9/1990 | Kinnan | 175/75 |
| 4,962,818 | 10/1990 | DeLucia | 175/75 |
| 4,974,688 | 12/1990 | Helton | 175/73 |
| 4,991,668 | 2/1991 | Rehm et al. | 175/61 |
| 4,995,465 | 2/1991 | Beck et al. | 175/27 |
| 4,995,466 | 2/1991 | Snow, Jr. | 175/61 |
| 5,002,138 | 3/1991 | Smet | 175/45 |
| 5,029,654 | 7/1991 | Wilson et al. | 175/74 |
| 5,297,641 | 3/1994 | Falgout, Sr. | 175/73 |

*Primary Examiner*—Terry Lee Melius
*Attorney, Agent, or Firm*—Flehr, Hohbach, Test, Albritton & Herbert

[57] ABSTRACT

A downhole drilling subassembly for use with a pressurized fluid carrying drill string extending from a well head down to a bottom of a bore hole. The drill string includes upper and lower sections disposed at an angle relative to each other and having respective upper and lower longitudinal axes. An upper subassembly portion is adapted to couple to the upper section of the drill string. A lower subassembly portion is rotatably carried by the upper subassembly portion and is adapted to couple to the lower section of the drill string. The upper and lower subassembly portions are hollow so as to permit the pressurized fluid to pass therethrough. An assembly responsive to raising the drill string off the bottom of the bore hole and lowering the drill string back onto the bottom of the bore hole is provided for rotating the upper and lower subassembly portions with respect to one another between first and second relative angular positions.

31 Claims, 7 Drawing Sheets

DOWNHOLE DRILLING SUBASSEMBLY AND METHOD FOR SAME

BRIEF DESCRIPTION OF THE INVENTION

This invention relates to downhole drilling subassemblies for use in geological drilling and more particularly to the use of downhole drilling subassemblies with pressurized fluid carrying drill strings.

BACKGROUND OF THE INVENTION

During the drilling of a bore hole in earth formations, it is often necessary to change the direction of the bore hole. Numerous tools exist for adjusting the direction of drilling. Adjustable bent subs, such as those disclosed by Wenzel (U.S. Pat. No. 4,745,982) and Wilson et al. (U.S. Pat. No. 5,029,654), are sometimes used to change the drilling direction. These subassemblies, however, do not permit adjustment of the bend angle between the axis of the drill string above the tool and the axis of the drill string below the tool once the subassembly is inserted in the bore hole. As a result, the drill string must be removed, or tripped, both for attachment of the subassembly and for removal of the subassembly once the direction of drilling has been changed.

Some tools permit limited changes in the deflection angle of the bore hole without tripping the drill string. In the tools disclosed by Kamp (U.S. Pat. No. 4,492,276), Geczy et al. (U.S. Pat. No. 4,667,751), Steiginga (U.S. Pat. No. 4,880,066), Delucia (U.S. Pat. No. 4,932,482) and Delucia (U.S. Pat. No. 4,962,818), the bend angle is preset either in the downhole motor housing or through the use of a bent sub. Directional drilling is achieved by rotating only the drill bit, and straight line drilling is achieved by rotating the drill bit and the down-hole motor and/or drill string. The drill string must be held stationary to hold a given directional angle, which is often difficult to achieve in practice. In addition, straight bore drilling through rotation of the drill string produces a bore hole diameter larger than needed or generated by other common drilling techniques. Furthermore, because it is fixed, the bend angle cannot be changed without tripping the drill string.

Other directional drilling tools are not limited to a preselected bend angle in the drill string. A change in the direction of drilling is achieved downhole, through the use of pistons, rollers or the like which are actuated once the drill string is in position, to either incline the drilling axis within the tool or incline the tool in the bore hole. Some of these tools, as disclosed by Page et al. (U.S. Pat. No. 2,891,769), cannot drill a straight bore hole, or, as disclosed by Evans (U.S. Pat. No. 4,291,773), cannot vary the predetermined bend angle while in the bore hole. Others, such as disclosed by Claycomb (U.S. Pat. No. 3,595,326), can vary only between a straight line and a preselected bend angle. Still others, as disclosed by Takaoka et al. (U.S. Pat. No. 4,046,204) and Edmond et al. (U.S. Pat. No. 4,281,723), can vary either the angle of bend from the longitudinal axis of the tool or the direction of bend about the longitudinal axis of the tool, but require separate control lines from the surface to the tool. All of these tools require, to varying degrees, complicated mechanical and pressurized fluid carrying parts.

Other subassemblies use the mud fluid pressure to effectuate changes downhole in the bend angle of the subassembly. The deviation tools of Schoeffler (U.S. Pat. No. 4,655,299) and Schoeffler (U.S. Pat. No. 4,895,214) each have an output shaft which can be caused to be alternately straight or bent by cycling the drilling fluid flow rate at the earth surface so as to cause a high or low flow resistance in the tool. The flow resistance can be detected at the earth surface for determining the configuration of the tool. However, each of these tools includes fragile spherical gimbals to permit pivoting of the output shaft.

Still other directional drilling tools permit downhole adjustment to a bend angle in the tool through the use of two cylindrical members which can be rotated with respect to one another to vary the bend angle from zero to an inherent maximum angle. Two such tools are disclosed in Wawrzynowski et al. (U.S. Pat. No. 4,884,643) and Smet (U.S. Pat. No. 5,002,138).

The tool in Wawrzynowski uses a subassembly coupled to the drill string comprising two cylinders each having a first straight portion which are concentrically coupled to each other and a second portion bent at the same oblique angle to the respective first portion and coupled to either the upper or lower portion of the drill string. Axial pumping of the upper drill string at a predetermined force causes incremental changes in the bend angle over a range from zero degrees to twice the oblique angle by rotating the cylinders with respect to each other at set angular amounts. An internal coil spring is provided for retaining the cylinders in the desired angular relationship. This device can be impractical and unworkable because the downward longitudinal forces on a drill string during operation can vary considerably thereby making it difficult to maintain at all times the necessary threshold force on the drill bit for retaining the desired bend angle. Furthermore, it has proven difficult to build a coil spring within the space available which can resist the normal and usual drill string downward forces on the drill bit without permitting transient compressions of the spring which can undesirably cause the bend angle to change.

In addition, the Wawrzynowski tool utilizes a complex rotator with various moving parts to accomplish the rotation. The tool does not include a device for signaling to the surface the position of the two cylinders with respect to each other, nor does the tool cause the longitudinal axis of the drill string above the tool to intersect at all times with the longitudinal axis of the drill string below the tool at the midpoint of the longitudinal centerline of the tool. This failure to so intersect can cause the drill bit to carve out an undesirable three-dimensional curved path rather than a simple two-dimensional path in the plane of the upper and lower drill strings.

Smet discloses a steerable drilling mole having a cylinder which has an oblique face and is rotatably driven about the central axis of the device. A ball is provided with an axially centered bore therethrough and an oblique face inclined at the same angle as the oblique face of the cylinder. The oblique face of the ball abuts the oblique face of the cylinder. Rotation of the cylinder in the housing causes the ball to rotate about an axis perpendicular to the central axis thereby adjusting the bend angle over a range from zero degrees to twice the angle of the oblique faces on the cylinder and ball. The driving motor, complex ball and socket joint and other fragile apparatus in the tool give rise to several sources of failure. In addition, the mole requires a separate high pressure line from the surface to operate the driving motor and an additional line to relay to the surface the position of the rotatable cylinder within the mole.

From the prior art, it is a clear that one of the goals in directional drilling is maximizing the rate of penetration and minimizing the costs of operation. Directional drilling tools which require tripping of the drill string to change the bend angle or to achieve directional drilling are not cost effective in most cases because of the accompanying delays in operation. Bend tools in the prior art which are adjustable down hole provide the opportunity for increased penetration rates, but are often accompanied by undesirable consequences. Many of these bend tools require dedicated control or other lines down hole which increase the costs of drilling. Most of these tools contain complicated and fragile mechanisms which are prone to failure and cause delays in the operation when not functioning correctly. The majority of these tools do not permit relatively unrestricted adjustment of the bend angle within a given range. During the operation of some of these tools, the longitudinal axes of the upper and lower drill strings are offset causing undesirable deviations in the bore hole. Furthermore, most of these tools have not considered the significant hydraulic forces within the tools which tend to separate the housings of the tool.

Variable relief valves have also been heretofore provided. Spring-loaded pressure relief valves, for instances, are commonly used to relieve excessive pressure from high pressure pumps and fluid lines. However, the common spring-loaded variable relief valve cannot tolerate high volume flow after it opens a short distance. Pressures above the relief pressure will maintain a relief valve in an open position, but the passage between the valve head and the valve seat is so narrow that serious erosion of the valve seat and head surfaces occurs very quickly.

As can be seen from the above discussion, there is a need for a bend tool adjustable downhole which requires no dedicated control or other lines downhole to adjust or measure the bend angle, is of a relatively simple and sturdy design with no fragile mechanical joints, can indicate at the well head the bend angle of the tool, and permits the longitudinal axis of the drill string above the tool to intersect on the longitudinal axis of the tool with the longitudinal axis of the drill string below the tool.

OBJECTS AND SUMMARY OF THE INVENTION

The primary object of the present invention is to provide a downhole directional drilling subassembly and method which is an improvement over the prior art.

Another object of the invention is to provide a subassembly of the above character which is of a relatively simple design.

Another object of the invention is to provide a subassembly of the above character which is relatively durable in design and minimizes the use of fragile or sophisticated components prone to failure.

Another object of the invention is to provide a subassembly and method of the above character which changes the mud fluid pressure, detectable at the well head, at which fluid flow commences through the subassembly to reflect a change in the bend angle of the subassembly.

Another object of the invention is to provide a subassembly and method of the above character which does not require any dedicated or special equipment at the well head to change the angle of drilling.

Another object of the invention is to provide a subassembly and method of the above character which utilize the reliable and reproducible operation of raising the drill string column a short distance off the bottom of the bore hole and then setting the drill string column back down again to change the angle of drilling.

In summary, the downhole drilling subassembly of the present invention is for use with a pressurized fluid carrying drill string extending from a well head down to a bottom of a bore hole. The drill string includes upper and lower sections disposed at an angle with respect to each other and having respective upper and lower longitudinal axes. An upper subassembly portion is adapted to couple to the upper section of the drill string. A lower subassembly portion is rotatably carried by the upper subassembly portion and is adapted to couple to the lower section of the drill string. The upper and lower subassembly portions are hollow so as to permit the pressurized fluid to pass therethrough. Means responsive to raising the drill string off the bottom of the bore hole and lowering the drill string back onto the bottom of the bore hole is provided for rotating the upper and lower subassembly portions with respect to one another between first and second relative angular positions.

Additional objects and features of the invention will appear from the following description from which the preferred embodiments are set forth in detail in conjunction with the accompanying drawings.

DETAILED DESCRIPTION OF THE INVENTION

Figure 1:
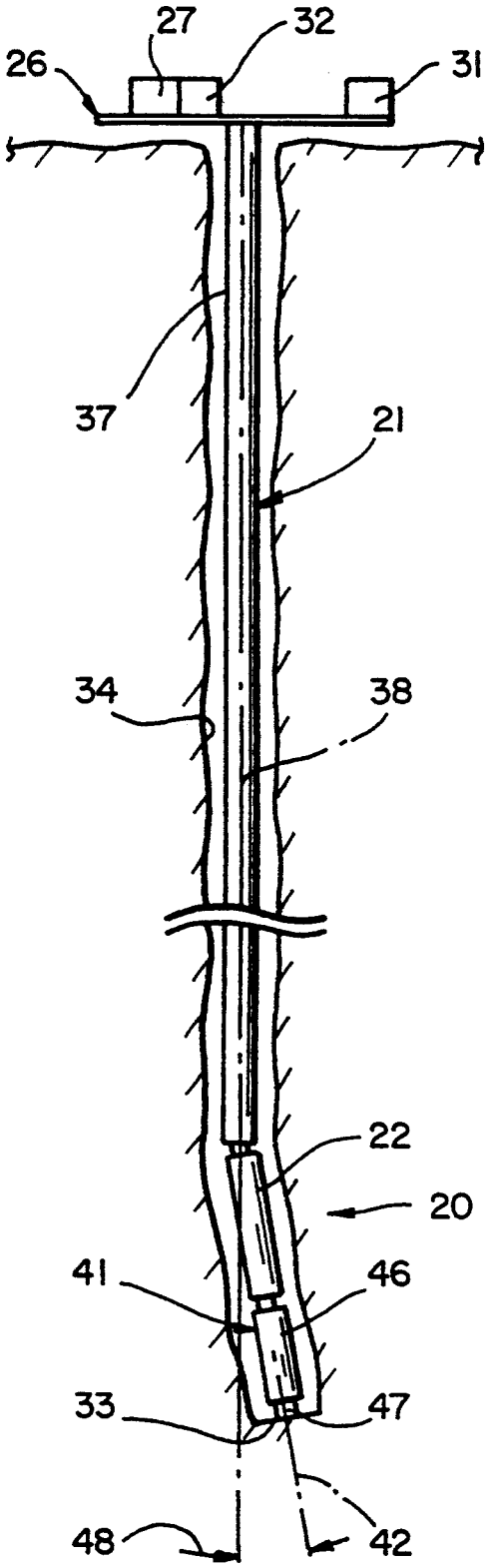
FIG. 1 is a side elevational view of a drilling apparatus which includes the downhole drilling subassembly of the present invention.

Reference will now be made in detail to the preferred embodiment of the invention, which is illustrated in the accompanying figures. The description of the embodiment of the invention will be followed by a discussion of its operation. Turning now to the drawings, wherein like components are designated by like reference numerals throughout the various figures, attention is directed first to FIGS. 1 through 15 which illustrate the preferred embodiment of the invention.

A drilling apparatus 20 having a hollow mud fluid carrying drill string 21 is shown in FIG. 1 with a downhole adjustable bend drilling subassembly 22 incorporating the present invention coupled near the end of drill string 21. Drilling apparatus 20 includes at well head 26 mud fluid high pressure pump equipment 27 for pressurizing the mud fluid in the drill string, a flow meter 31 for measuring the flow of mud fluid through drill string 21 and a pressure gage 32 for measuring the mud fluid pressure at the well head. The drill string extends from well head 26 down to a bottom 33 of a bore hole 34, and is comprised of an upper section 37 above subassembly 22 having a central longitudinal axis 38 and a lower section 41 below subassembly 22 having a central longitudinal axis 42. Lower section 41 includes a conventional downhole motor 46 with a drill bit 47 attached at the lower end thereof for engaging bore hole bottom 33. Subassembly 22 has a bend angle 48, which can range from 0° to a predetermined angle and is preferably 1°, so that upper and lower drill string sections 37 and 41 are disposed at an angle with respect to each other.

Figure 2:
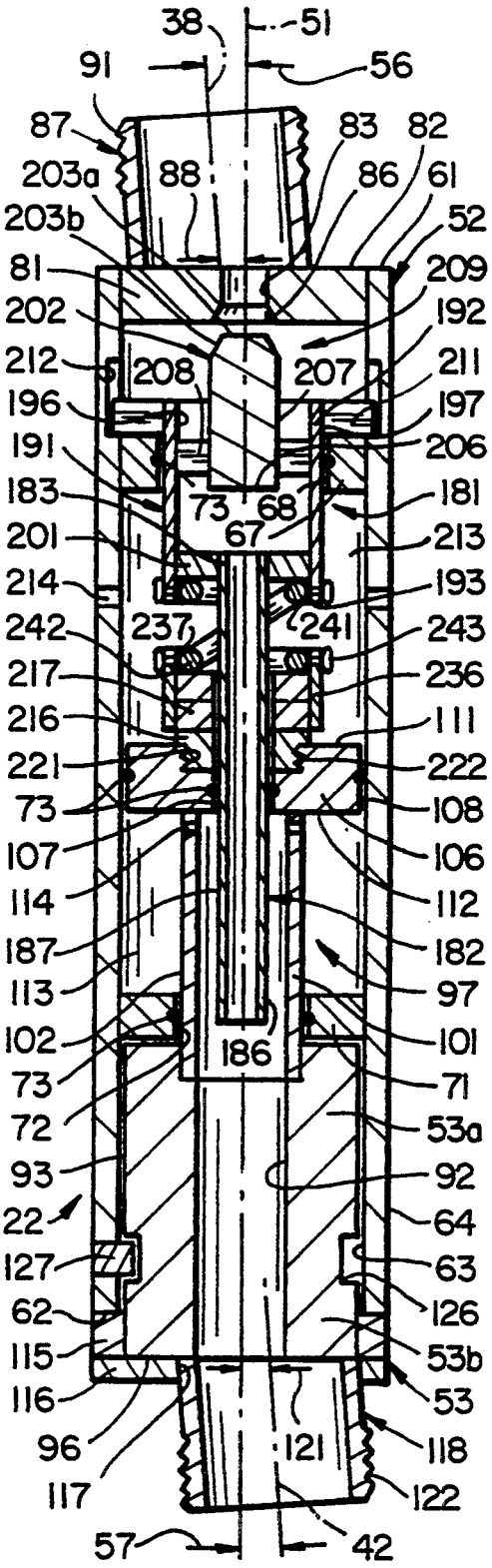
FIG. 2 is a side cross-sectional view of the downhole drilling subassembly of FIG. 1 in a first operational position.
Figure 3:
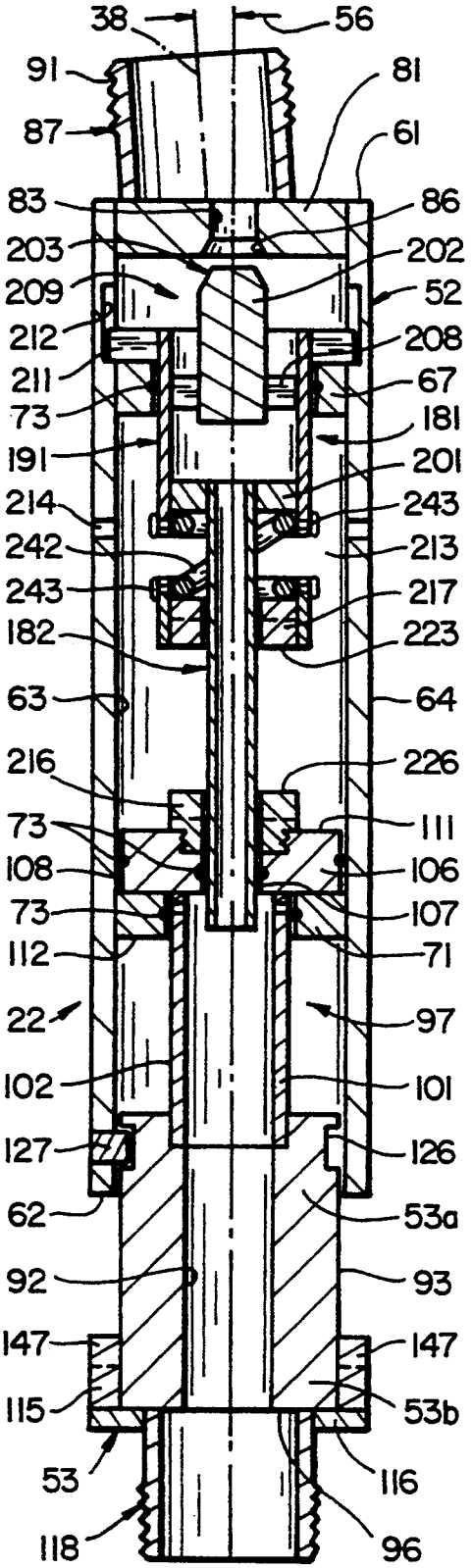
FIG. 3 is a side cross-sectional view of the downhole drilling subassembly of FIG. 1 in a change bend position.
Figure 4:
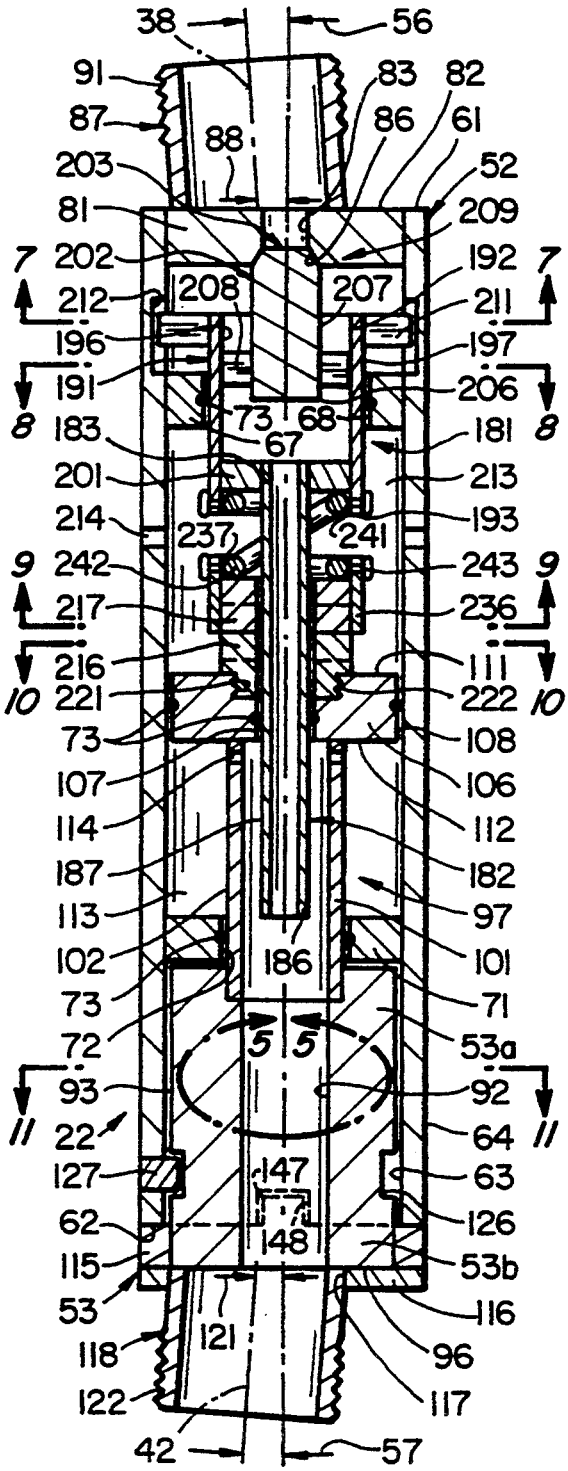
FIG. 4 is a side cross-sectional view of the downhole drilling subassembly of FIG. 1 in a second operational position.

Briefly and as shown in FIGS. 2 through 4, subassembly 22 has a longitudinal centerline 51 and includes first or upper and second or lower subassembly portions or housings 52 and 53 which extend along and are coaxial with subassembly centerline or axis 51. Upper or outer housing 52 and lower or inner housing 53 are each tubular and hollow so as to permit pressurized mud fluid to flow therethrough. Upper housing 52 is adapted to couple to upper section 37 of drill string 21 at an oblique angle beta, identified in the drawings by reference number 56, and rotationally and axially moves with upper section 37. Lower housing 53 is rotatably carried by upper housing 52 and is adapted to nonrotatably couple to lower section 41 of the drill string at oblique angle beta, identified in the drawings by reference number 57.

During drilling operations, drill string 21 is suspended from well head 26 and mud motor 46 is mounted to the end of drill string lower section 41 and resting on bore hole bottom 33. The motor is pressed against bottom 33 by a predetermined portion of the weight of the drill string and powered in a conventional manner by the pressurized mud fluid flowing down drill string 21 to effectuate drilling. Upon cessation of drilling, the lifting of drill string 21 at well head 26 raises motor 46 off of bore hole bottom 33 and the lowering of the drill string puts it back down again on bottom 33 causing housings 52 and 53 to rotate with respect to each other as shown generally in FIGS. 2 through 4. This simple operation of first raising and then lowering the drill string causes bend angle 48 of subassembly 22 to change from 0° to twice beta, or vice versa.

Longitudinally extending outer tubular housing 52 is made of any suitable material such as steel and has upper and lower ends 61 and 62 and inner and outer surfaces 63 and 64 which are circular in cross-section as illustrated in FIGS. 7 through 11. An upper annular ring or collar 67 having a circular in cross-section inner surface 68 axially centered about housing centerline or axis 51 and a lower annular ring or collar 71 having a circular in cross-section inner surface 72 axially centered about axis 51 are bolted or otherwise suitably joined to inner surface 63. Each of collars 67 and 71 is made of steel or any other suitable material and has an annular groove, not shown in the drawings, formed on the inner surface thereof for carrying an annular hydraulic seal or ring 73 made of any suitable material such as rubber on said inner surface. An inside top plate or cap 81 is bolted, welded or otherwise suitably joined to inner surface 63 adjacent upper end 61 of upper housing 52 and, together with upper end 61, forms end surface 82 of subassembly 22. Top cap 81 is provided with a central circular opening or bore 83 which extends therethrough for permitting pressurized mud fluid to enter drilling subassembly 22. Bore 83 is formed with a circular tapered or beveled surface at the lower or inside portion thereof to form valve seat 86.

Means for coupling subassembly 22 to upper section 37 of drill string 21 is carried by the upper end of upper housing 52 and includes a tubular threaded nipple 87 made from any suitable material such as steel and joined by any suitable means such as welding to end surface 82. Nipple 87 has a centerline which is coincident with axis 38 of drill string upper section 37 and offset from axis 51 by a distance identified in the drawings by reference number 88. The nipple centerline is inclined with respect to axis 51 at oblique angle 56. Threads 91 are formed around the outside of the nipple to facilitate mounting subassembly 22 to the upper section of the drill string. It should be appreciated, however, that nipple 87 could be a female connector with internal threads and be within the scope of the present invention.

Figure 11:
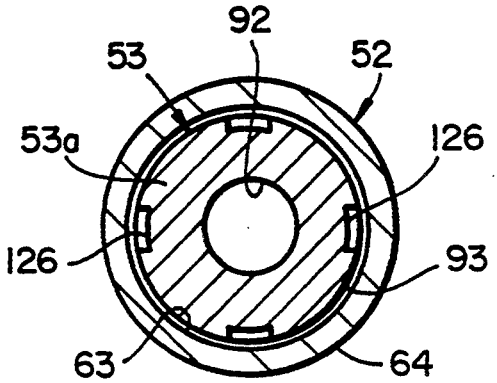
FIG. 11 is a cross-sectional view taken along the line 11—11 of FIG. 4.

Longitudinally extending inner or lower tubular housing 53 is made of any suitable material such as steel and has upper and lower portions **53*a* and 53*b* and inner and outer surfaces 92 and 93, which are circular in cross-section as shown in FIG. 11, and a lower end 96. A tubular piston element 97, made from steel or any other suitable material, extends axially upward from upper portion 53*a* and includes a tubular stem 101 rigidly mounted to upper portion 53*a* by any suitable means such as welding. Stem 101 has a circular outer surface 102 and an opposite circular inner Surface with approximately the same radius as inner surface 92 of upper portion 53***a*. An annular piston head 106 with opposite inner and outer surfaces 107 and 108 which are circular in cross-section and opposite parallel upper and lower surfaces 111 and 112 extending perpendicularly between surfaces 107 and 108 is welded or otherwise rigidly mounted to the upper end of stem 101. Annular grooves not shown in the drawings are provided in inner and outer surfaces 107 and 108 for seating and retaining hydraulic seals 73 therein.

Stem outer surface 102 and piston head outer surface 108 are radially sized so that seal 73 disposed on lower collar inner surface 72 slidably engages stem outer surface 102 and seal 73 disposed on piston head outer surface 108 slidably engages inner surface 63 of housing 52. In this manner, inner housing 53 is carried by outer housing 52 so as to be movable and slidable along axis 51 between a first longitudinal position in concentric engagement with outer housing 52, with upper portion 53*a* concentrically carried within outer housing 52 as shown in FIGS. 2 and 4, and a second longitudinal position in extension with respect to outer housing 52, as shown in FIG. 3. An annular cavity 113 is formed on the sides by stem 101 and housing 52 and on the ends by piston head 106 and lower collar 71. A plurality of circumferentially spaced-apart bleed holes 114 extend through the inner and outer surfaces of stem 101 into annular cavity 113.

The engagement of piston head 106 with lower collar 71 serves to limit the downward travel of inner housing 53 relative to outer housing 52. An annular stop ring or collar 115 made from a suitable material such as steel is mounted around outer surface 93 adjacent lower end 96 by any suitable means such as bolts or welding. Stop collar 115 serves to limit the upward travel of inner housing 53 relative to outer housing 52 when abutting lower end 62 of the outer housing. When the inner housing is in its first longitudinal position, piston head 106 is spaced above lower housing upper portion 53*a* so that no drilling operation drill forces are transmitted through the inner string components which include piston element 97 and upper portion 53*a* of lower housing 53.

An end plate or cap 116 made from a suitable material such as steel is welded or otherwise suitably mounted to housing lower end 96 and stop collar 115. An off-center opening 117 is provided in end cap 116 and nipple 118 is rigidly mounted by welding or other suitable means to the end cap. Nipple 118 is made from any suitable material such as steel and serves as means for coupling or mounting subassembly 22 to lower section 41 of drill string 21. Nipple 118 has a centerline which is coincident with lower drill string section axis 42 and offset from axis 51 by a distance identified in the drawings by reference number 121. The nipple centerline is inclined with respect to subassembly axis 51 at oblique angle 57. Offset distance 121 and angle 122 are approximately equal to offset distance 88 and oblique angle 57 of upper nipple 87. Threads 122 are formed around the outside of lower nipple 118 to facilitate mounting of the subassembly to the lower section of the drill string.

A spiral ratchet means or assembly responsive to raising drill string 21 off bore hole bottom 33 and lowering the drill string back onto bottom 33 is carried by outer and inner housings 52 and 53 for continuously rotating the housings with respect to one another between first and second relative angular positions shown respectively in FIGS. 2 and 4. This relative rotation of housings 52 and 53 causes subassembly bend angle 48, and hence the angle between upper and lower sections 37 and 41 of drill string 21, to change from 0° to twice beta or vice versa. For example, FIGS. 2 through 4 illustrate a change in bend angle 48 from 0° to twice angle 56 or 57. In general, this rotation means includes a groove 126 machined or otherwise suitably formed on outer surface 93 of the upper portion of lower or inner housing 53 and a pin 127 extending between outer and inner surfaces 64 and 63 of upper or outer housing 52 and having a portion extending into groove 126 for travel therein causing rotation of inner housing 53 relative to outer housing 52.

Figure 5:
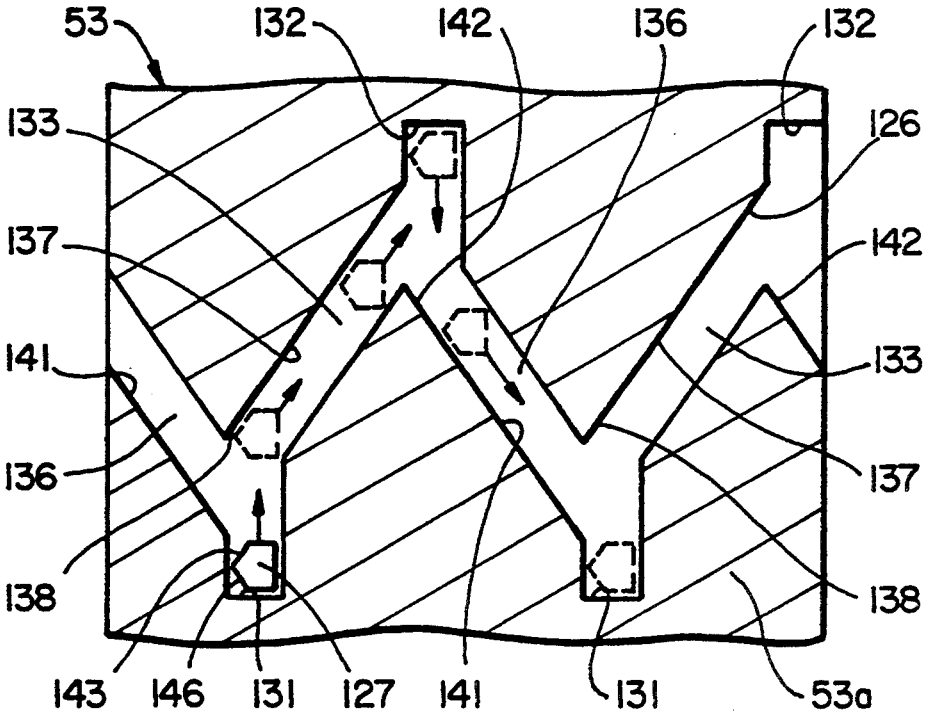
FIG. 5 is a circumferential cross-sectional view, rotated 90 degrees, taken along the line 5—5 of FIG. 4.

More specifically, groove 126 extends continuously around the circumference of outer surface 93 in a zigzag pattern or configuration (See FIG. 5). Groove 126 includes two lower sockets 131for housing pin 127 when inner housing portion 53*a* is retracted within outer housing 52 and two upper sockets 132 for housing the pin when inner housing 53 is extended from the outer housing in its second longitudinal position. Two first or up groove portions 133 extend upwardly in a clockwise direction around the inner housing from each lower socket 131 to an upper socket 132 and two second or down groove portions 136 extend downwardly in a clockwise direction between each upper socket to a lower socket. As such, groove portions 133 and 136 extend in directions diagonal to centerline 51 of the subassembly and intersect at sockets 131 and 132.

Up groove portions 133 are formed with an upper guiding surface 137 which engages pin 127 during the down-stroke portion of the two-stroke cycle when the inner housing is moving longitudinally downward to its second position. In this regard, guiding surfaces 137 have leading portions 138 which are angularly aligned about axis 51 with lower sockets 131 so that pin 127 engages a guiding surface as the inner housing moves downward relative to the outer housing. Down groove portions 136 are formed with lower guiding surfaces 141 which engage the pin during the up-stroke when the inner housing is moving upwardly relative to the outer housing back to its first or operational position. Leading portions 142 of the lower guiding surfaces are angularly aligned about axis 51 with upper sockets 132 to cause the pin to engage a lower guiding surface and move in the proper clockwise direction during the up-stroke portion of the longitudinal movement cycle. In this manner, groove 126 is formed to cause inner housing 53 to rotate continuously in a single or clockwise direction as pin 127 travels through groove 126 during each stroke cycle.

Pin 127 is cross-sectionally sized to accommodate the shear forces experienced as it travels along surfaces 137 and 138 and is preferably formed with a first flat side surface 143 for sliding along upper guiding surface 137 and a second flat side surface 146 for sliding along lower guiding surface 138. Groove 126 has a width larger than the transverse dimension of pin 127 so as to permit the pin to easily travel therealong.

In FIG. 5, pin 127 is shown in solid lines in one lower socket 131 and in dotted lines in the other lower socket. The solid line pin 127 in lower socket 131 corresponds to subassembly 22 in its first operational position illustrated in FIG. 2 and the dotted line pin in the lower socket corresponds to the subassembly in its second operational position illustrated in FIG. 4. A dotted line pin is also shown in an upper socket 132 so as to correspond to subassembly 22 in its change bend position illustrated in FIG. 3. As can be appreciated, inner housing 53 rotates relative to outer housing 52 approximately 90° in each down-stroke and up-stroke portion of the cycle so that the inner housing rotates approximately 180° during each change in operational position.

Keyway means in the form of cooperatively mating locking lugs and slots 147 and 148 are carried respectively by housings 53 and 52 for rotationally locking housing 53 relative to housing 52 while housing 53 is in its first longitudinal position. Lugs 147 are circumferentially spaced-apart along the top of stop collar 115, preferably in a symmetrical arrangement, and extend upwardly therefrom for disposition in corresponding aligned slots 148 provided in lower end 96 of outer housing 52. Lugs and slots 147 and 148 come into angular alignment to permit engagement therebetween when housings 53 and 52 are in relative operational positions as shown in FIGS. 2 and 4. A lug 147 and slot 148 are shown in dotted lines in FIG. 4 in an operational condition. Lugs 147 have a longitudinal dimension less than the longitudinal depth of slots 148 so as to permit stop collar 115 to abut lower end 96 and distribute the longitudinal forces exerted between the upper and lower sections of drill string 21 circumferentially around the stop collar and outer housing 52. Lower sockets 131 serve to guide lower housing 53 back into upper housing 52 such that locking lugs 147 properly engage locking slots 148. When subassembly 22 is in an operational position, pins 127 do not engage any of the side surfaces of groove 126, as shown in FIG. 5 with respect to the pins 127 in lower sockets 131, and as a result do not experience any of the drilling forces exerted upon the subassembly.

It should be appreciated that groove 126 can have other configurations and be within the scope of the present invention. For example, guiding surfaces 137 and 141 need not be straight as shown in the drawings, but can be irregular so long as the slope of surface 137 is always positive and the slope of surface 141 is always negative. As a result, the machining of these surfaces is not critical and does not require close tolerances. Smoothness of surfaces 137 and 141 and pin surfaces 143 and 146, however, is important so as to minimize the frictional forces between the inner housing and the pin.

Figure 6:
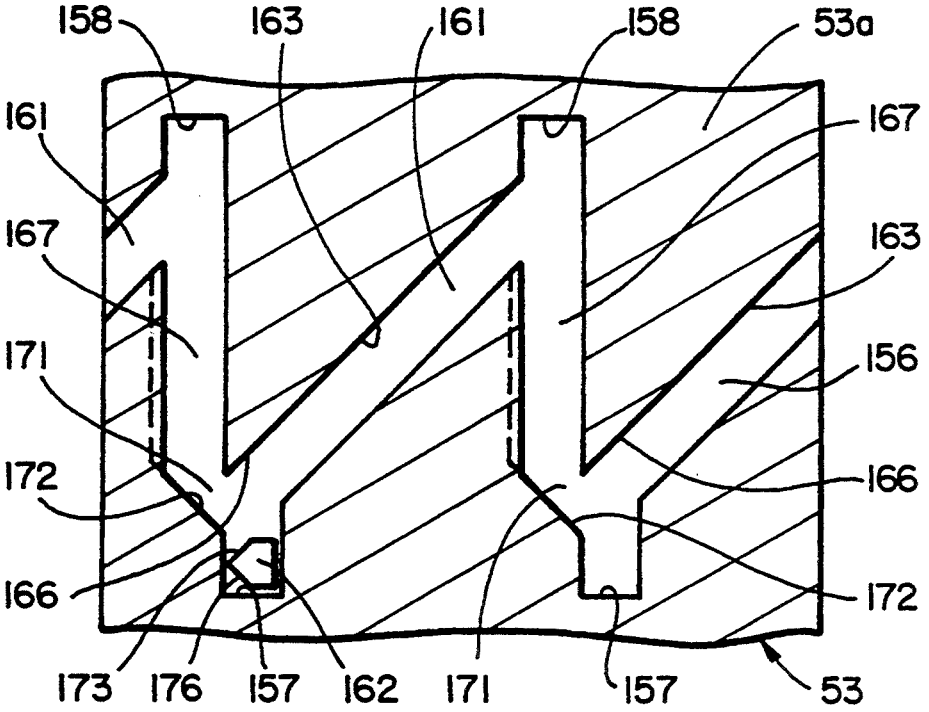
FIG. 6 is a circumferential cross-sectional view, similar to FIG. 5, of another embodiment of the downhole drilling subassembly of the present invention.
Figure 7:
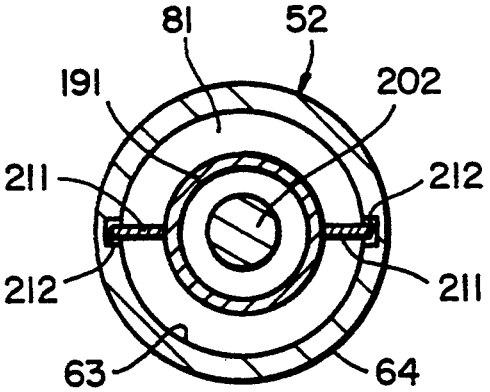
FIG. 7 is a cross-sectional view taken along the line 7—7 of FIG. 4.

In an alternate embodiment of the downhole drilling subassembly of the present invention, a groove 156 is provided on outer surface 93 of inner housing 53 which causes approximately 180° rotation of the inner housing with respect to outer housing 52 in the down-stroke portion of the up-down longitudinal movement cycle of the inner housing relative to the outer housing. As illustrated in FIG. 6, groove 156 includes two upper and two lower sockets 157 and 158 and an up groove portion 161 extending upwardly from each lower socket 157 to the adjacent upper socket 158. A pin 162 is mounted to outer housing 52 and extends into groove 156 for travel therein. Each up groove portion has an upper guiding surface 163 with a leading portion 166 for engaging pin 162 and causing the inner housing to rotate as it moves downwardly in response to the raising of drill string 21 at well head 26.

Up groove portions 161 intersect a generally vertical down groove portion 167 at upper sockets 158, portions 167 causing inner housing 53 to move generally nonrotatably as it returns to its second longitudinal position in concentric engagement with outer housing 52. Down groove portions 167 have a slant portion 171 at the lower end thereof which end at lower sockets 157 and permit pin 162 to engage the adjoining upper guiding surface 163 at the beginning of the next cycle. Slant portions 171 are formed with a lower surface 172 for guiding pin 162 into the lower socket and permit the pin to engage leading portion 166 at the beginning of the next rotation cycle. Down groove portions 167 can have a slightly wider transverse dimension, as shown in dotted lines in FIG. 6, for ensuring that pin 162 does not follow the wrong path onto portion 161 instead of proceeding down portion 167. Pin 162 is formed with first and second flat surfaces 173 and 176 aligned for respective general planar engagement with guiding surfaces 163 and 172.

The spiral ratchet means of the present invention can be constructed so that inner housing 53 rotates through any desired sequence of incremental rotations during each full 360° rotation cycle of inner housing 53 relative to outer housing 52, so long as the sum of these incremental rotations equals 360°.

Alignment means which includes transversely offset upper and lower nipples 87 and 118 is provided in downhole drilling subassembly 22 for causing longitudinal axis 38 of drill string upper section 37 to intersect at all times with longitudinal axis 42 of drill string lower section 41 on housing longitudinal axis 51. Axes 38 and 42 intersect at approximately the center of axis 51 so that drill string sections 37 and 41 are in general colinear alignment, as shown in FIG. 2, during straight bore drilling and intersect at the center of axis at an angle equal to twice angle 56 or 57, as shown in FIG. 4, during directional drilling.

A tubular second piston element 181 made from any suitable material such as steel is slidably carried by upper and lower housings 52 and 53 so as to be axially centered on longitudinal centerline 51 and carry pressurized mud fluid therethrough. Piston element 181 includes a lower portion or tube 182 having upper and lower ends 183 and 186 and an outer surface 187 which is circular in cross-section and diametrically sized so as to snugly and slidably engage hydraulic seal 73 disposed on inner surface 107 of piston head 106. Piston element 181 further includes an upper portion or tube 191 having upper and lower ends 192 and 193 and inner and outer surfaces 196 and 197 which are each circular in cross-section and diametrically larger than the related surfaces of lower tube 192. Lower tube outer surface 187 is rigidly attached and sealed at upper end 183 thereof to upper tube inner surface 196 near lower end 193 thereof by an annular collar 201 which is welded or otherwise tightly joined to the upper and lower tubes. Upper tube outer surface 197 is diametrically sized so as to snugly and slidably engage hydraulic seal 73 disposed on inner surface 68 of upper collar 67. As described and illustrated in FIGS. 2 and 4, upper collar 67.and piston head 97 and the hydraulic seals 73 provided on the inner surfaces thereof serve to retain piston element 181 in an axially centered position within housings 52 and 53 and to permit the longitudinal movement of piston element 181 within the housings between the positions shown in FIGS. 2 and 4.

A cylinder member or valve head 202 having an upper end surface 203, a lower end 206 and an outer surface 207, which is generally circular in cross-section, is mounted to upper tube 191 by four brackets or fins 208 welded or otherwise suitably at one end to outer surface 207 and at the other end to inner surface 196.

Figure 8:
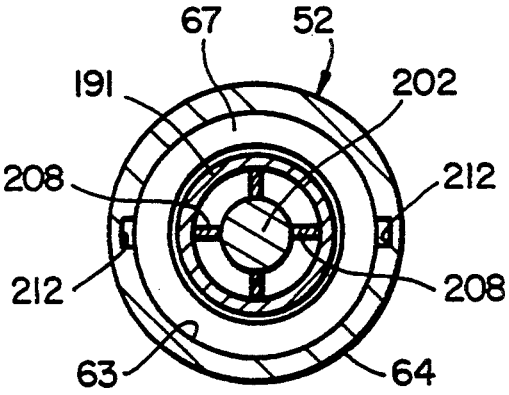
FIG. 8 is a cross-sectional view taken along the line 8—8 of FIG. 4.

Fins 208 are longitudinally aligned on and symmetrically spaced apart around outer surface 207 adjacent lower end 206 (see FIGS. 4 and 8). Fins 208 serve to axially center valve head 202 on longitudinal centerline 51. End surface 203 is in the form of a truncated cone, having a planar portion 203*a* and a tapered peripheral or contact portion 203*b* extending thereabout and configured for aligned and snug engagement with valve seat 86 formed on the inside of top cap 81. Valve seat 86 and piston element 181, including valve head 202 thereof, are included within the valve means or assembly 209 of downhole drilling subassembly 22. As discussed above, valve seat and 86 and valve head 202 of the valve assembly are movable relative to each other.

A pair of thin brackets or fins 211 are welded at one end to outer surface 197 of upper tube 191 adjacent upper end 192 and extend radially outwardly therefrom in opposite directions. The outer end of each fin 211 is slidably disposed in a longitudinally extending keyway or channel 212 formed in inner surface 63 of upper housing 52 (see FIGS. 4 and FIG. 7). The two channels 212 are longitudinally sized so as to permit fins 211 to move upwardly a distance sufficient for valve head 202 to seat in valve seat 86, as shown in FIG. 4, and to move downwardly into engagement with upper collar 67 so that valve head and seat 202 and 86 are in a fully wide open position, as illustrated in 2. The downward engagement of fins 211 with upper collar 67 serves to limit the downward longitudinal movement of piston element 181 within upper and lower housings 52 and 53. In this manner, fins 211, channels 212 and collar 67 serve as means for limiting the downward movement of piston element 181 within the upper and lower housings of subassembly 22. Fins 211 and channels 212 also serve as means for restricting piston element 181 from rotating about longitudinal centerline 51 in upper housing 52.

An annular cavity 213 hydraulically sealed from the pressurized mud fluid within subassembly 22 is formed on the sides by piston element 181 and upper housing 52 and on the ends by upper collar 67 and piston head 106. A plurality of holes 214 are circumferentially spaced around upper housing 52 and extend therethrough into cavity 213 to permit mud fluid from outside subassembly 22 to enter the cavity. Without such pressure equalization in cavity 213, the pressure differential across piston head 106 would equal the combined hydrostatic pressure plus the pressure drop across mud motor 46 and may exceed the design limits of seals 73.

Means is included within drilling subassembly 22 for longitudinally positioning fins 211 above upper collar 67 and for positioning valve head 202 toward its closed position and away from its fully open position. This positioning means includes first and second annular spacer elements or washers 216 and 217 made of any suitable material such as metal and circumferentially disposed about lower tube 191. First or lower washer 216 is adjustably carried by piston head 106 so as to extend upwardly from upper surface 111 thereof. The lower end portion of washer 216 is disposed within a threaded annular recess 221 extending through upper surface 111 of piston head 106 around the inside thereof and is provided with threads 222 around the lower end portion which are included within the means for elevationally adjusting washer 216 above piston head 106. Lower washer 216 has an upper surface 223 and second or upper washer 217 has a lower surface 226 which abut to elevationally support the upper washer within upper housing 52.

Figure 9:
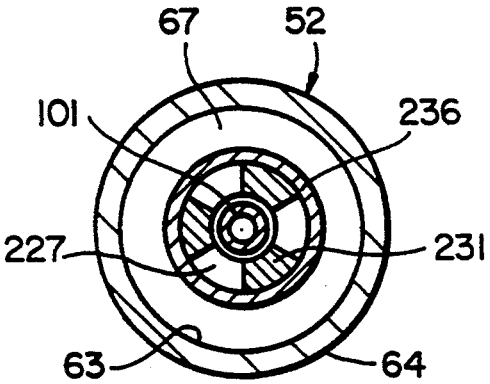
FIG. 9 is a cross-sectional view taken along the line 9—9 of FIG. 4.
Figure 10:
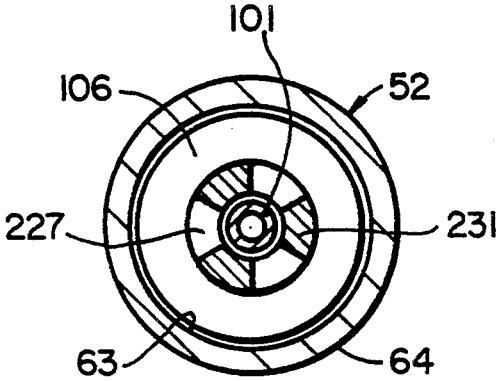
FIG. 10 is a cross-sectional view taken along the line 10—10 of FIG. 4.

As shown in FIGS. 9 and 10, abutting surfaces 223 and 226 are each machined with a plurality of slots 227 circumferentially and symmetrically spaced-apart thereabout to form a plurality of longitudinally-extending risers 231 thereon between the slots. Slots 227 and risers 231 should be of equal dimensions and depth and should each subtend an approximate equal angle about axis 51. In FIGS. 9 and 10, each of the three slots and risers subtend an angle of approximately 60°. More specifically, slots 227 and risers 231 are longitudinally and angularly sized so as to permit upper washer 217 to be disposed in a first angular position relative to lower washer 216, where risers 231 are each disposed in a slot 227, and in a second angular position relative to the lower washer, where risers 231 on the upper washer oppose and abut the risers on the lower washer. In its first position illustrated in FIG. 2, upper washer 217 is spaced a first longitudinal distance above piston head 106 and in its second position, illustrated in FIG. 4, the upper washer is spaced a second and greater longitudinal distance above the piston head. Variable relief valve 209 is closed when upper washer 217 is in its second position (See FIG. 4).

In the preferred embodiment for configuring slots 227 and risers 231 in a two-position subassembly with 180° relative rotation of housings 52 and 53 between positions slots 227 subtend an angle slightly greater than 60°, for example 70°, and risers 231, subtend an angle slightly less than 60°, for example 50°. This provides approximately 10° of tolerance such that the risers can properly abut even when the incremental rotation between housings 52 and 53 is 180°, plus or minus 5°. In this embodiment, the longitudinal forces between washers 216 and 217 are transmitted relatively evenly around surfaces 223 and 226 thereof and undesirable transverse torques on piston element 97 are minimized or eliminated.

Other configurations of slots 227 and risers 231 can be provided and be within the scope of the present invention. Preferably, these alternate configurations should have alternating slots and risers circumferentially spaced around the opposed mating surfaces, with each slot and riser subtending an approximate equal angle. Where angle alpha is the relative angle of rotation between the upper and lower housing between each change bend position of the subassembly, angle alpha being evenly divisible into 360°, the aggregate number of slots and risers in each angular segment of the surfaces subtending angle alpha should equal an odd number. Such an arrangement ensures that the longitudinal forces transmitted through washers 216 and 217 are supported by contact surfaces evenly spaced around the surface of the washers and that sideways torques are minimized if not eliminated. In the embodiment described in FIGS. 9 and 10, angle alpha equals 180° and the aggregate number of slots 227 and risers 231 in each angular segment of surfaces 223 and 226 subtending 180° equals three.

Means for coupling upper washer 217 to piston element 181 includes a tubular bracket 236 mounted at one end around the outside of the upper washer by any suitable means such as welding. Bracket 236 extends upwardly beyond upper washer 217 to form an annular recess 237 between the bracket and lower tube 182 of piston element 181. A similar annular recess 241 is formed by the lower end portion of upper tube 191 which extends downwardly beyond annular collar 201 and lower tube 182. A coil spring 242 is disposed about lower tube 182 and has a lower end portion disposed within recess 237 so as to abut the upper end of upper washer 217 and an upper end portion disposed within recess 241 so as to abut the lower end of annular collar 201. Set screws 243 are circumferentially disposed about tubular bracket 236 and upper tube 191 and threadedly extend therethrough for securing spring 242 within recesses 237 and 241 and rotationally locking spring 242 and upper washer 217 with piston element 181 about centerline 51.

Figure 12:
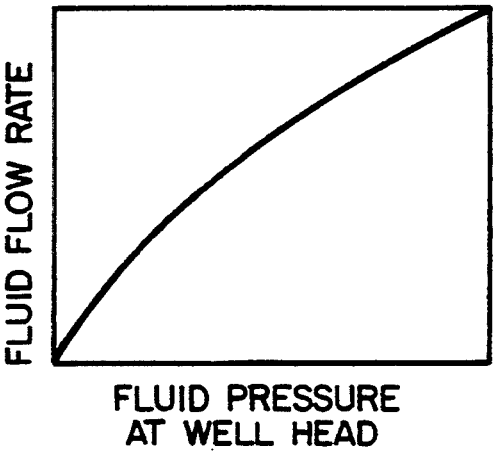
FIG. 12 is graph of the fluid flow rate versus fluid pressure at the well head of the downhole drilling subassembly in its first operational position shown in FIG. 2.

Signaling means is carried by upper housing 52 for adjusting the pressure of the mud fluid at well head 26 at which fluid flow commences through subassembly 22 to reflect the rotation of upper and lower housings 52 and 53 with respect to one another between their first and second relative angular positions illustrated in FIGS. 2 and 4, respectively. This signaling means includes the valve assembly 209, upper and lower spacer washers 216 and 217 and coil spring 242. When downhole drilling subassembly 22 is in its first operational position for straight bore drilling, spacer washers 216 and 217 are in their first relative angular position with slots 227 and risers intermeshed so that piston element 181 with valve head 202 mounted thereon is moved away from valve seat 86. In this moved away position, valve assembly 209 is generally fully open and creates minimal resistance to the pressurized mud fluid flowing through subassembly 22. A typical flow rate versus pressure curve, as measured by flow meter 31 and pressure gages 32 at well head 26 when subassembly 22 is in its first operational and zero bend position, is shown in FIG. 12. As illustrated therein, the flow rate through subassembly 22 increases as fluid pressure at the well head increases. It should be noted that the actual flow rate units will depend upon the dimensions of drill string 21 and subassembly 22. Spring 242 is in a relaxed position when no fluid is flowing through subassembly 22 and will compress during high-pressure fluid flow in response to the opposed hydraulic forces acting upon the upper effective surface area of piston element 181 and upon lower surface 112 of piston head 106.

Upon cessation of drilling and 180° rotation of lower housing 53 relative to upper housing 52 in the manner discussed above, so that subassembly bend angle changes from 0° to twice angle 56 or 57, lower washer 216 carried and coupled to lower housing 53 rotates 180° relative to upper washer 216 so that the spacer washers are in their second relative angular position with risers 231 thereof abutting. In this second position, upper washer 217 is disposed farther upward in the upper housing than when in its first position, causing piston element 181 to move upward so that valve head 202 is disposed in and engaged with valve seat 86. As can be seen from FIGS. 2 and 4, the changing of bend angle 48 from 0° to twice angle 56 or 57 causes valve assembly 209 to change from a fully open position to a closed position. In this regard, spacer washers 216 and 217 are included within the adjustment means of subassembly 22 which in response to the relative angular position of housings 52 and 53 adjusts the position of valve seat and head 86 and 202 relative to each other.

Of course, spacer washers 216 and 217 can be angularly configured so as to open valve assembly 209 during directional drilling and close the valve assembly during straight bore drilling. In addition, where subassembly 22 is designed so as to permit bend angle 48 to equal 0°, twice angle 56 or 57 and one or more magnitudes therebetween, it should be appreciated that washers 216 and 217 can be-configured and positioned so as to cause an initial pressure surge at alternate angular configurations of the subassembly, thus providing positive signalling at the well head of the angular positions of subassembly 22.

When valve assembly 209 is in a closed position, spring 242 is caused to compress and thereby serves as means for biasing valve head 86 toward its closed position. As discussed above, lower spacer washer 216 is threadedly joined to piston head 106. Threads 222 permit the lower spacer washer to be screwed inwardly and outwardly of threaded recess 221 in the piston head so as to adjust the lower spacer washer upwardly and downwardly in upper housing 52. By this adjustment, threads 222 permit spring 242 to be further compressed or relaxed and, as such, are included within the means carried by housings 52 and 53 for adjusting the compressive force exerted by the spring.

When drilling operations commence with valve assembly 209 in a closed position, the pressurization of drill string 21 at well head 26 through pump equipment 27 results in a buildup of fluid pressure at the well head with no corresponding fluid flow through subassembly 22. Once the fluid pressure above valve assembly 209 reaches a predetermined level sufficient to open the valve assembly, fluid flow commences through subassembly 22 and the fluid pressure at well head 26 is increased significantly.

Figure 13:
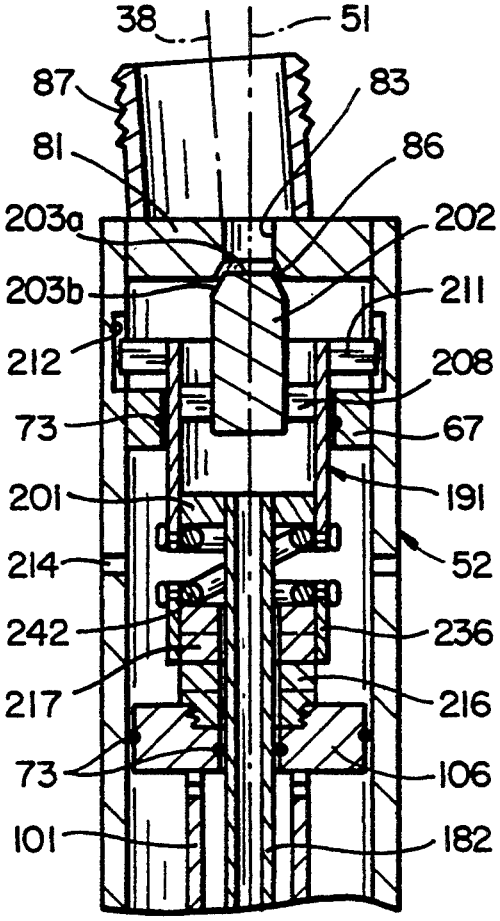
FIG. 13 is a side cross-sectional view of a portion of the downhole drilling subassembly of FIG. 1 in a third operational position.
Figure 14:
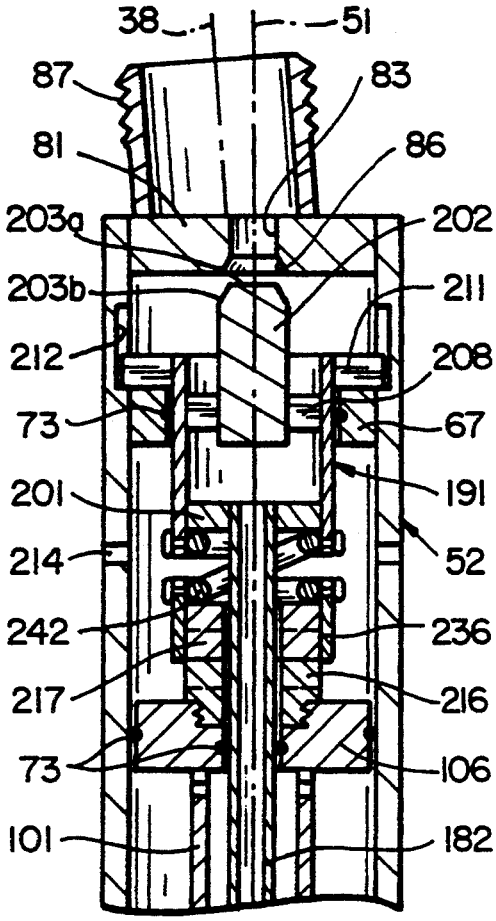
FIG. 14 is a side cross-sectional view of a portion of the downhole drilling subassembly of FIG. 1 in a fourth operational position.

Means is included within subassembly 22 for changing valve assembly 209 through relative longitudinal movement of valve seat and head 86 and 202 from a closed position illustrated in FIG. 4, to a first open position illustrated in FIG. 13 when the fluid pressure at the well head reaches the predetermined level and thereafter to a second or fully open position illustrated in FIG. 14. This opening means includes end surface 203 of valve head 202 which serves as first hydraulic means responsive to the pressurized fluid for moving the valve head from its closed to first open position. Planar portion **203*a* of end surface 203 is transversely sized with a cross-sectional area sufficient to cause pressurized fluid above a predetermined pressure to open the valve head slightly and permit the passage of pressurized mud fluid through top cap opening 83**.

Piston element 181 is included within the second hydraulic means responsive to pressurized fluid flow through subassembly 22 for moving valve head 202 from its first open position to its second open position so as to permit high volume fluid flow through opening 83 and subassembly 22. Piston element 181 has an effective upper piston head, to which valve head 202 is mounted, with an approximate cross-sectional area based upon the outside diameter of upper tube 191 and an effective lower piston head with an approximate cross-sectional area based upon the outside diameter of lower tube 182. Since the diameter of upper tube 191 is greater than the diameter of lower tube 183, piston element 181 is caused to move downwardly within upper housing 52 and valve head 202 thereof is caused to move to its second open position once high-volume, high pressure fluid flow commences through valve opening 83 and pressurizes the inside of subassembly 22. As discussed above, the downward movement of piston element 181 is limited by the engagement of fins 111 with upper collar 67.

Figure 15:
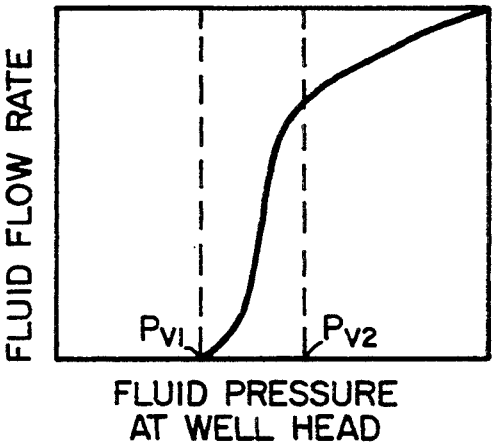
FIG. 15 is graph of the fluid flow rate versus fluid pressure at the well head of the downhole drilling subassembly in its second operational position shown in FIG. 4.

The initial absence of fluid flow with increased fluid pressure at the well head can be easily detected at the well head by flow meter 31 and pressure gage 32 and serves as a signal to the drillers that adjustable bend subassembly 22 is in a directional drilling configuration. A graph of flow rate versus fluid pressure for subassembly 22 in its second operational position is shown in FIG. 15. As shown therein, no fluid flow occurs through the subassembly until the predetermined pressure of $P_{v1}$ is reached, at which time valve assembly 209 moves to its first open position for permitting fluid flow therethrough. As the valve assembly opens above $P_{v1}$, a small amount of fluid flow begins through the valve assembly with a large pressure drop thereacross. As the well head pressure increases further, however, the fluid in subassembly 22 exerts a net downward longitudinal force on piston element 181 which causes the valve assembly to open widely to its second fully open position. Once the pressure $P_{v2}$ has been achieved, the flow rate versus pressure curve is substantially similar to the curve shown in FIG. 12 for subassembly 22 in its first operational position.

Piston head 106 is included within the hydraulic means of subassembly 22 for retaining inner housing 53 in concentric engagement with outer housing 52 when pressurized fluid is passing through housings 52 and 53. When drilling motor 46 is resting on bore hole bottom 33, inner housing 53 is retained in its first longitudinal position in part by the weight of drill string upper section 37. Upon the commencement of drilling, however, fluid in subassembly 22 pressurized above a certain level can cause inner housing 53 to longitudinally separate from outer housing 52, particularly if a void in the earth is encountered during drilling. This downward hydraulic force has a first component which derives from the downward hydraulic force exerted by the fluid on piston element 181. This force is transferred to coil spring 242, but is offset in part by the reactive force of upper collar 67 engaging fins 211 of the piston element. The net downward force is transmitted through spacer washers 216 and 217 to inner housing 53. A second component of this downward force corresponds to the hydraulic force exerted on inner housing lower portion 53*b* and is generally proportional to the cross-sectional area of lower tube 182. Since annular cavity 213 is hydraulically sealed by seals 73 on inner surface 68 of upper collar 67 and inner and outer surfaces 111 and 112 of piston head 106, the pressurized mud fluid is unable to enter cavity 213 and exert a downward force on upper surface 111 of the piston head.

As a counterbalance to the aggregate downward hydraulic force, bleed holes 114 in stem 101 permit pressurized fluid to enter annular cavity 113 and exert an upward force on the piston head. This upward force is generally proportional to the area of piston head lower surface 112, which is sized so that the upward hydraulic forces thereon are greater than the aggregate hydraulic downward force within subassembly 22. Inner housing 53 is rigidly coupled to piston head 106 and is retained in concentric engagement with outer housing 52 by this net upward hydraulic force.

In the currently preferred embodiment of the invention, subassembly 22 has a length, excluding nipples 87 and 118, of approximately 10 feet. Upper or outer housing 52 has outer and inner diameters of approximately 9 and 7 inches, respectively, and lower or inner housing 53 has outer and inner diameters of approximately 7 and 4 inches, respectively. Offset distances 88 and 121 for nipples 87 and 118 equal approximately ½ inch and angles 56 and 57 are approximately ½°. Opening 83 in top cap is approximately 2½ inches in diameter. Stem 101 and upper and lower tubes 191 and 182 have respective outer and inner diameters of approximately 4⅝ and 3⅝ inches, 4½ and 3½ inches, and 3½ and 2½ inches. Valve head 202 has an outer diameter of approximately 2½ inches and is sized relative to upper tube 191 so that approximately 40% of the internal cross-sectional area of tube 191 is open for fluid flow around the open valve head. Piston head 106 has respective outer and inner diameters of 7 and 3½ inches. A suitable coil spring 242 has a k value of 1500 lbs/in, and a length of approximately 14 inches. In this embodiment, the variable relief pressure when subassembly 22 is in a second or changed bend position is approximately 500 psi.

In operation and use, the method and apparatus of the present invention permits change of bend angle 48 (see FIG. 1) through the use of standard and existing drill string equipment at the well head of all drilling rigs. No additional control lines or apparatus which communicate with well head 26 or additional motors on drill string 21 are needed to facilitate a change in bend angle 48.

The method of the invention generally comprises the steps of attaching downhole adjustable bend subassembly 22 to upper and lower sections 37 and 41 of drill string 21, attaching mud motor 46 to the end of the drill string and putting subassembly 22 and mud motor 46 down bore hole 34 so that the mud motor is resting on bottom 33 thereof. When desirous of changing bend angle 48 of the subassembly, either before drilling of after drilling has commenced, the pumping of any pressurized mud fluid down the drill string is stopped. Thereafter, drill string 21 is raised off bore hole bottom 33 to cause lower housing 53 to rotate with respect to upper housing 52 and thereby change bend angle 48 of subassembly 22. The substantial weight of lower section 41, typically 5,000 to 15,000 pounds, is more than sufficient to guarantee extension of lower housing 53 from upper housing 52 when drill string 21 is raised at well head 26 to change bend angle 48; no additional predetermined longitudinal forces are required to cause relative extension of housings 52 and 53. In the preferred embodiment of the invention, the drill string is lowered back onto bottom 33 to cause the lower housing to continue rotating in the same direction with respect to the upper housing so as to further change the bend angle and return the subassembly to an operational locked position. During this second step of the cycle, drill bit 47 acts as a pivot to permit the lower housing to rotate relative to the upper housing. No additional predetermined downward pressure on the drill string other than normal drilling forces is required to close the subassembly and maintain the new operational bend angle.

Subassembly 22 has no fragile or complex components susceptible to failure from the weight of drill string 21, the pressure of the mud fluid or any of the other forces exerted on the subassembly during drilling operations. In general, subassembly 22 is constructed entirely of concentric tubular members which are as strong as the drill string itself. No machine tolerances are needed beyond the normal and usual tolerances required of high pressure hydraulic cylinder-piston assemblies. In addition, none of the internal movable parts of subassembly 22 are subjected to the weight of upper section 37 of the drill string when the subassembly is in its normal operational position with lower housing portion 53*a* within upper housing 52 and the stop collar 115 mounted on the lower housing abutting lower end 62 of the upper housing. Instead, these forces are transmitted through upper housing 52 directly to stop collar 115.

The offset attachment of nipples 87 and 118 to upper and lower housings 52 and 53 serves to minimize undesirable sideways drilling by mud motor 46 by causing upper longitudinal axis 38 of the drill string to intersect lower longitudinal axis 42 on the midpoint of subassembly longitudinal centerline 51. Axes 38 and 42 so intersect during straight bore drilling, when the subassembly is in a zero bend position, and directional drilling, when the subassembly is in a changed bend position. If axes 38 and 42 were not colinear during straight bore drilling, as in many subassemblies currently provided, a rotational torque is exerted on drill string lower section 53 causing drill bit 47 to drill sideways as if subassembly were in a changed bend position.

Subassembly 22 has a hydraulic compensating piston, which includes piston head 106, for retaining lower housing 53 in concentric operational engagement with upper housing 52 during drilling despite the significant fluid pressure forces which would otherwise cause the housings to longitudinally separate. In this regard, upper collar 67 reduces the magnitude of the downward pressure forces exerted by piston element 181 on the lower housing and sealed annular cavity 213 restricts the pressurized fluid within the subassembly from bearing on upper surface 111 of piston head 106. The fluid pressure forces exerted on lower surface 112 of the piston head are greater than the aggregate fluid separation forces on housings 52 and 53 and serve to retain the housings in concentric engagement.

The spiral ratcheting pin and groove assembly of the present invention contains no gate assemblies or other fragile mechanisms and, as a result, can withstand significantly greater shear forces than pin and groove assemblies currently provided. The unique configuration of continuous groove 126 permits the travel of pin 127 therein to cause lower housing 53 to rotate relative to upper housing 52 as the lower housing moves downwardly and then back upwardly relative to the upper housing. The pin travels through the groove unobstructed, engaging only the side surfaces of the groove. This assembly can withstand very great shear forces in order to effect reliable relative rotation even when lower section 41 of drill string 21 is constrained or bound by contact with the sides of bore hole 34.

No dedicated monitoring lines are needed to confirm the position of drilling subassembly 22 and bend angle 48 thereof. Different threshold pressures dependent upon the angular position of housings 52 and 53 must be exceeded to initiate continuous mud fluid flow through the subassembly. These relief pressures are set well below the normal drilling operation mud fluid pressures. Spacer washers 216 and 217 cause valve assembly 209 to be in an initial open or closed condition dependent on the relative angular position of upper and lower housings 52 and 53, which relative position also determines bend angle 48. As discussed above, initial closure of the valve assembly precludes fluid flow through subassembly 22 until a predetermined pressure sufficient to open valve assembly 209 is achieved. Mud fluid pressure at the well head must be raised above the relief valve opening pressure before fluid flow begins through subassembly 22. The absence of initial fluid flow and the jump in flow once the predetermined pressure is reached provides a positive and easily measured signal that subassembly 22 is in its second operational or bent position.

The magnitude of the opening pressure for the valve assembly can be selected through the choice of coil spring 242 and the longitudinal dimension of risers 231 and can be adjusted by longitudinally positioning lower washer 216 relative to piston head 106 with threads 222 and threaded recess 221 so as to change the compression force exerted by the coil spring on piston element 181 and contact surface **203*b* of valve head 202** when the valve assembly is in a closed position.

Valve assembly 209 serves as a variable relief valve which permits high volume fluid flow therethrough. Unlike conventional spring loaded variable relief valves, valve assembly 209 has two open positions. Once pressurized fluid above subassembly 22 reaches the predetermined relief pressure, valve head 202 is caused to move longitudinally downward relative to valve seat 86 into a first open position. Thereafter, the mud fluid pressure at the well head can be increased significantly to cause valve head 202 to move further downward and open the valve assembly to its second open position. In this position, a high volume of fluid is permitted through opening 83 and subassembly 22 without eroding or causing damage to valve assembly 209. Fins 211 engage upper collar 67 to restrict further downward movement of piston element 181.

The design of spacer washers 216 and 217 in subassembly 22 avoids the problem of the common mated spacer washer design which uses only one 180° slot in each washer. This common arrangement results in all longitudinal forces being transmitted through one side of each washer, causing washers sliding longitudinally within an axially centered tube to bind therein.

Figure 16:
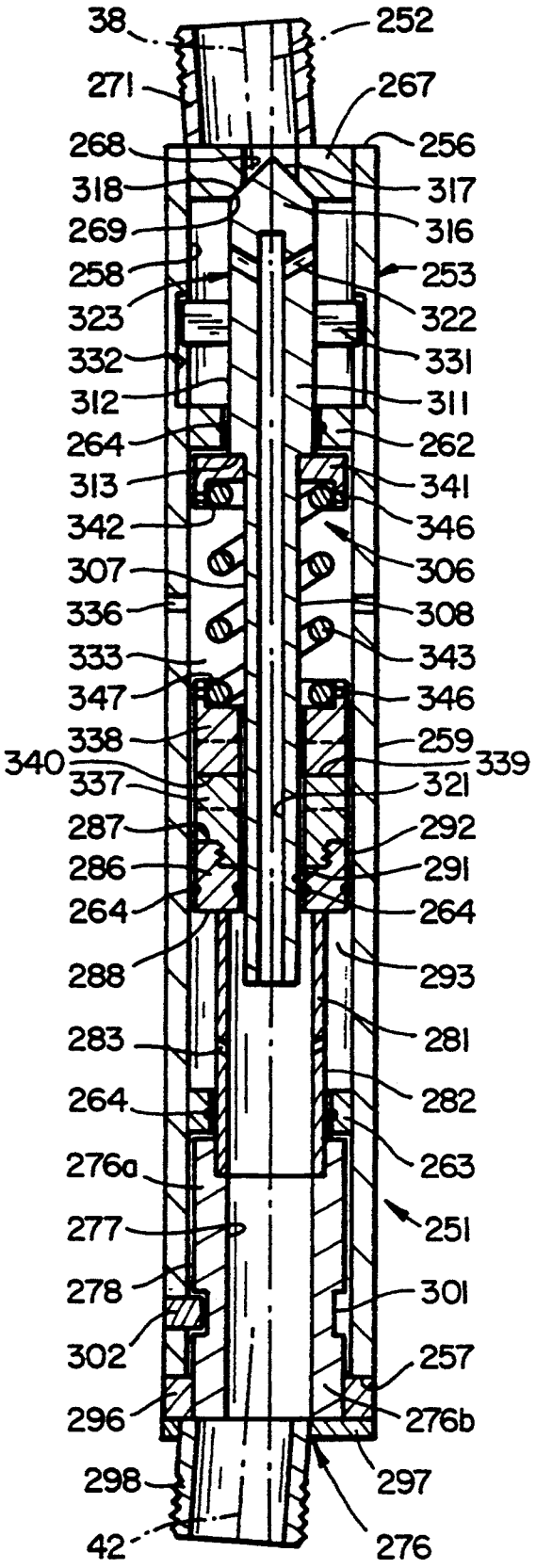
FIG. 16 is a side cross-sectional view of another embodiment of the downhole drilling subassembly of the present invention.
Figure 17:
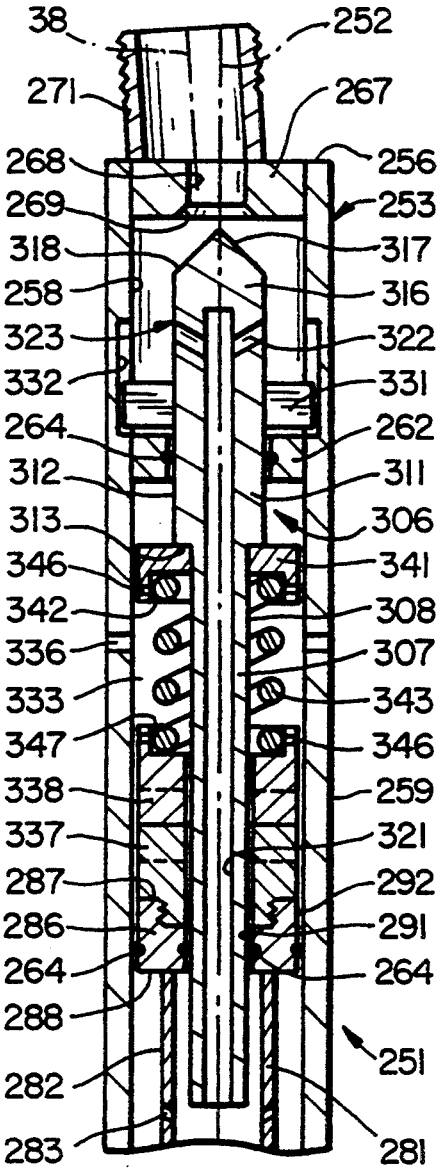
FIG. 17 is a side cross-sectional view of a portion of the downhole drilling subassembly of FIG. 16 in another operational position.

The drilling subassembly of the present invention can have other embodiments. For example, FIGS. 16 and 17 illustrate a downhole adjustable bend drilling subassembly 251 similar to subassembly 22 and extending along a longitudinal centerline or axis 252. Subassembly 251 includes an upper or outer tubular housing 253 having upper and lower ends 256 and 257 and inner and outer surfaces 258 and 259. Upper and lower annular collars 262 and 263 are mounted to inner surface 258 in spaced apart positions and are provided with annular hydraulic seals 264 on the inside circular in cross-section surfaces thereof. A top cap 267 is mounted to inner surface 258 adjacent upper end 256 and is provided with an axially aligned opening 268 therethrough formed in part by a valve seat 269 at the lower end of the opening. A threaded upper nipple 271 is mounted to housing upper end 256 and top cap 267 in an offset position and at an oblique angle for coupling subassembly 251 to upper section 37 of drill string 21.

A lower or inner tubular housing 276 is carried by upper housing 253 and has upper and lower portions **276*a* and 276*b* and inner and outer surfaces 277 and 278. An upstanding tubular stem 281 is mounted to upper portion 276*a* and extends upwardly therefrom inside the upper housing. Stem 281 has an outer surface 282 which slides on the seal 264 of lower collar 263 and is provided with a plurality of circumferentially disposed bleed holes or ports 283 which extend therethrough. An annular piston head 286 having upper and lower surfaces 287 and 288 and inner and outer surfaces 291 and 292 is mounted at its lower surface to the upper end of stem 281. Ring seals 264 are disposed on the inner and outer surfaces of the piston head, with the outer seal permitting the piston head to slidably engage inner surface 258 of upper housing 253. An annular cavity 293 is formed on the sides by stem 281 and upper housing 253 and on the ends by piston head 286 and lower collar 263 and pressurized mud fluid is permitted therein,by bleed holes 283. An annular stop ring or collar 296 is mounted around outer surface 259 adjacent lower end 257 of the upper housing. An end cap 297 is mounted to the lower end of housing lower portion 276***b* and stop collar 296 and has an off-center opening therein in which threaded lower nipple 298 is mounted at an oblique angle to centerline 252. Nipples 271 and 298 are inclined relative to centerline 252 at equal oblique angles.

Upper and lower housings 253 and 276 are movable between first and second relative longitudinal positions in the same manner as housings 52 and 53 of subassembly 22. Piston head 286 engages lower collar 263 to limit the downward movement of lower housing 276 with upper housing 253 and stop collar 296 engages lower end 257 of the upper housing to limit the upward movement of the lower housing within the upper housing. Piston head 286 is also included within the hydraulic means of subassembly 251 for retaining lower housing 276 in its first longitudinal position in,concentric engagement with upper housing 253 when pressurized fluid is passing through the subassembly.

Outer surface 278 of lower housing 276 has a continuous groove 301 extending circumferentially therearound in a zig-zag pattern, substantially similar to groove 126 as shown in FIG. 5 for subassembly 22, and a pin 303 is mounted to and extends radially inwardly from upper housing 253 for travel within groove as housing 276 moves longitudinally relatively to housing 253. Cooperatively mating locking lugs and slots, not shown in the drawings, are provided respectively on stop collar 296 and lower end 257 for rotationally locking housings 253 and 276 when in a concentrically engaged and operational position.

An axially extending tubular piston element 306 is slidably carried within housings 253 and 276 and includes a lower tube 307 having an outer circular in cross-section surface 308 slidably engaging seal 264 on piston head inner surface 291. An upper tube 311 is rigidly joined to the lower tube and extends upwardly therefrom. Upper tube 311 has an outer circular in cross-section surface 312 which has a diameter greater than lower tube outer surface 303 and slidably engages seal 264 on the inside of upper collar 262. Outer surface 303 steps out to outer surface 312 at a shoulder 313 which extends generally perpendicularly therebetween. A solid valve head 316 is formed on the upper end of upper tube 311 and includes a conical-like end portion with tapered upper and base surfaces 317 and 318. An axially aligned central passageway 321 extends from valve head 316 downwardly through tubes 311 and 307. Upper tube 311 is provided with a plurality of circumferentially spaced-apart ports 322 behind valve head 316 which permit the pressurized fluid within subassembly 251 to enter the central passageway and flow through tubes 311 and 307. Valve seat 269 and piston element 306, including valve head 316 thereof, are included within valve means or assembly 323 of subassembly 251.

Piston element 306 permits relative movement between valve seat and head 269 and 316 so that the valve head can move into engagement with valve seat for closing valve assembly 323 and move away from the valve seat for opening the valve assembly and permit pressurized fluid to enter subassembly 251. In the closed position, base surface 318 of valve head 316 engages valve seat 269. A plurality of thin fins 331 are mounted in circumferential and symmetrical position to outer surface 312 of upper tube 311 and extend radially outwardly therefrom. The outer ends of fins 331 are disposed in channels 332 provided in inner surface 258 of upper housing 253. Fins 331 serve to restrict piston element 306 from rotating about centerline 252 relative to upper housing 253 and to limit the downward longitudinal travel of the piston element in the subassembly upon engaging upper collar 262.

An annular cavity 333 sealed from the pressurized fluid within subassembly 251 is formed on the sides by piston element 306 and upper housing 253 and on the ends by upper collar 262 and piston head 286. Circumferentially spaced holes 337 extend through upper housing 253 to permit fluid from outside the subassembly to enter cavity 333. Lower and upper annular spacer washers 337 and 338, substantially similar to spacer washers 216 and 217 of subassembly 22, are disposed in cavity 333 about lower tube 331. Lower washer 337 is threadedly mounted to the upper end of piston head 286 so as to be longitudinally positionable with respect to the piston head. Washers 337 and 338 have opposite upper and lower surfaces 341 and 342 which abut at all times so that the upper washer rides on the lower washer within cavity 333.

An annular bracket 341 is disposed around lower tube 307 and is rigidly joined thereto adjacent shoulder 313. Bracket 341 is provided with an annular recess 342 on the inside of the lower end thereof. A coil spring 343 is disposed in cavity 333 about lower tube 307 and has an upper end snugly and nonrotatably mounted within recess 342 and secured therein by set Screw 346 threadedly extending radially through bracket 341 into the recess. An annular recess 347 is also provided on the inside of the upper end of upper washer 338. The lower end of spring 343 is snugly and nonrotatably mounted in recess 347 and secured thereto by set screw 346 threadedly held by the upper washer. In this manner, upper washer 338 is nonrotatably coupled to piston element 306. Washers 337 and 338 have slots and risers, not shown in the drawings but substantially similar to slots and risers 227 and 231, provided on surfaces 341 and 342 thereof for longitudinally positioning upper washer 338 relative to lower washer 337 in dependence on the rotational position of upper and lower housing 253 and 276. In a manner similar to that discussed above for subassembly 22, valve assembly 323, spacer washers 337 and 338 and coil spring 343 are included within the signaling means of subassembly 251.

Subassembly 251 is illustrated in FIG. 16 in a change bend operational position with valve assembly 323 in a closed position. FIG. 17 shows subassembly 251 during pressurized use, with valve assembly 323 shown in dotted lines in a first open position for permitting pressurized fluid to pass through opening 268 and in solid lines in a second open position for permitting high volume pressurized mud fluid to pass through the valve assembly. Upper surface 317 of valve head 316 is in engagement with the pressurized fluid in drill string upper section 37, having a cross-sectional area generally equal to that of opening 268 in top cap, and serves as first hydraulic means responsive to the pressurized fluid for moving valve assembly 333 from its closed position to first open position. Base surface 318 of the valve head is exposed to the pressurized fluid once valve assembly 333 is initially opened and serves as means responsive to the pressurized fluid for moving valve assembly 333 to its second open position.

Downhole adjustable bend drill subassembly 251 is operated and used in substantially the same manner as drilling subassembly 22 discussed above. The subassembly causes axes 38 and 42 of the upper and lower sections 37 and 41 of drill string 21 to intersect on centerline 252 at all times. In the variable relief valve assembly 333 of subassembly 251, there is a net hydraulic force pushing valve head 316 away from valve seat 269 so long as the outside diameter of the valve head is larger than the outside diameter of lower tube 307. Subassembly 251 is simpler in construction than subassembly 22, though not as desirable as subassembly 22 because ports 322 present an obstruction to mud fluid flow when high volume flow is required.

Figure 18:
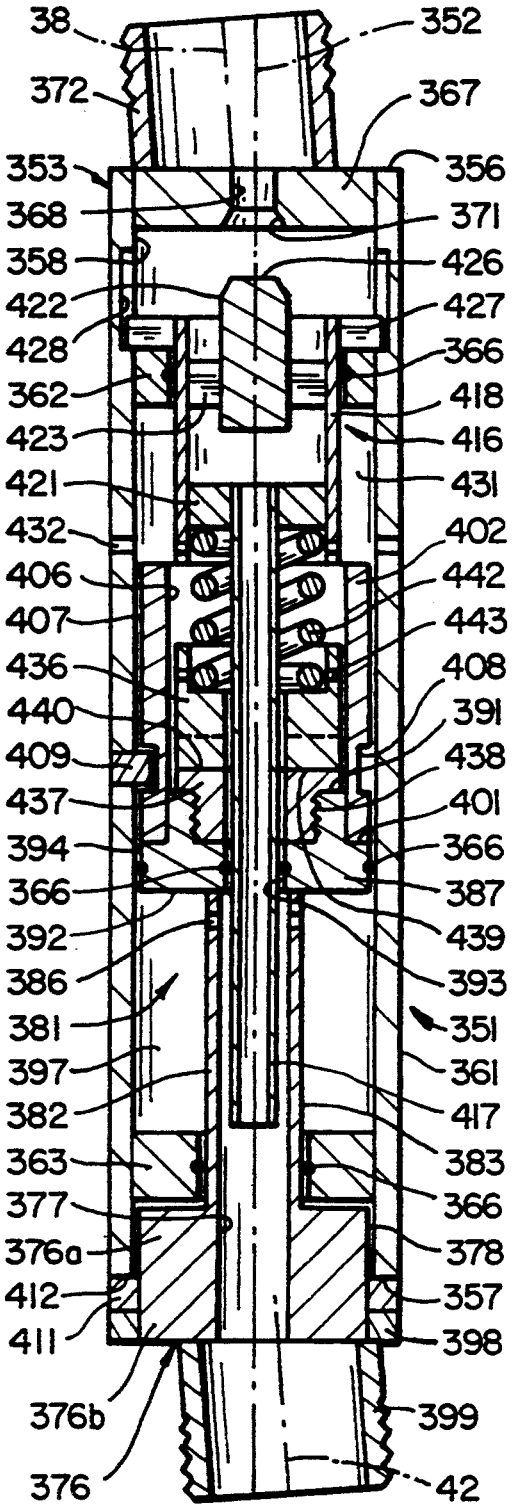
FIG. 18 is a side cross-sectional view of another embodiment of the downhole drilling subassembly of the present invention.

In another embodiment of the present invention, a down hole adjustable bend drilling subassembly 351 is illustrated in FIG. 18 which is substantially similar to subassembly 22 except that the spiraling ratcheting means extends upwardly from the hydraulic compensating piston. More specifically, subassembly 351 extends along a longitudinal centerline 352 and includes an axially extending upper housing 353 having upper and lower ends 356 and 357 and inner and outer surfaces 358 and 361 which are circular in cross-section. Upper and lower annular collars 362 and 363 are mounted in spaced-apart position to inner surface 358 and have hydraulic seal rings 366 mounted to the inner surfaces thereof in central alignment about axis 352. An top disk or cap 367 is mounted to inner surface 358 adjacent upper end 356 and is provided with a centrally disposed bore or valve opening 368 extending therethrough. The inner surface of the top cap which forms opening 368 is downwardly and outwardly tapered at the bottom thereof for forming valve seat 371. A threaded upper nipple 372 is mounted to the upper outside of top cap 367 in an offset position from centerline 352 and at an oblique angle thereto for coupling subassembly 351 to upper section 37 of drill string 21.

A lower housing 376 axially centered on longitudinal axis 352 is included within subassembly 351 and has upper and lower portions **376*a* and 376*b* and inner and outer surfaces 377 and 378. An axially centered piston element 381 extends upwardly from lower housing upper portion 376a and includes a tubular stem 382 with an inner surface coincident about centerline 352 with inner surface 377 and an outer surface 383 which is radially sized so as to slidable engage with seal ring 366 mounted to the inside surface of lower collar 363. A plurality of circumferentially disposed bleed holes 386 extend through stem 382. An annular piston head 387 having opposite upper and lower surface 391 and 392 and opposite inner and outer surfaces 393 and 394 is mounted at its lower surface to the upper end of stem 382. Seal rings 366 are circumferentially disposed about surfaces 393 and 394 in annular grooves (not shown) formed therein and outer surface 393 is radially sized to slidably engage inner surface 358 of the upper housing. An annular cavity 397 is formed on the sides by upper housing 353 and stem 382 and on the ends by piston head 387 and lower collar 363. An annular stop collar 398 is rigidly mounted circumferentially about lower portion 376*b* adjacent the lower end of lower housing 376. A threaded lower nipple 399 is mounted to lower portion 376*b* and the stop collar in a radially offset position from centerline 352 and extends downwardly therefrom at an oblique angle from centerline 352. Nipples 372 and 399 are inclined relative centerline 352** at equal oblique angles.

Lower housing 376 is movable between upper and lower longitudinal positions relative to upper housing 353, with piston head 387 abutting lower collar 362 to limit the downward movement of the lower housing at its lower longitudinal position. Stop collar 398 abuts upper housing lower end 357 to limit the upward movement of the lower housing at its upper position. Piston head lower surface 392 is included within the hydraulic compensating means of subassembly 351 for creating an upward hydraulic force to counterbalance the downward hydraulic separation force on lower housing 376 and thereby retain the lower housing in its upper longitudinal position during operation.

Subassembly 351 includes rotation means responsive to the movement of lowering housing 392 from its upper and lower positions relative to upper housing 353. In this regard, piston head 387 is formed with an outer annular recess 401 which opens onto upper and outer surfaces 391 and 394 thereof. A tubular housing 402 having inner and outer surfaces 406 and 407 is rigidly joined to piston head 387 and has a lower end disposed within outer annular recess 401. Outer surface 407 is radially sized for slidable disposition within upper housing 353 and is provided with a continuous groove 408, substantially similar to groove 126 for subassembly 22 as illustrated in FIG. 5, extending circumferentially therearound in a zig-zag pattern. A pin 409 is mounted to upper housing 353 and extends inwardly therefrom for travel in groove 408. Cooperating groove 408 and pin 409 serve to relatively rotate housings 353 and 376 during the upward and downward travel of lower housing 376. Upstanding locking lugs 411 are spaced around stop collar 398 and cooperatively mate with locking slots 412 formed in lower end 357 of upper housing 353 for rotationally locking housings 353 and 376 when lower housing 376 is in its upper longitudinal position.

The balance of downhole drilling subassembly 351 is substantially identical to subassembly 22 and includes an axially centered piston element 416 formed from lower and upper tubes 417 and 418 joined at respective upper and lower ends by annular collar 421 rigidly joined to the outer surface of lower tube 417 and the inner surface of upper tube 418. The outer surface of lower tube 417 slidably engages seal ring 366 disposed on piston head inner surface 393 and the outer surface of upper tube 418 slidably engages the seal ring disposed on the inside surface of upper collar 362. The upper tube is radially sized to fit concentrically within tubular housing 402. A longitudinally centered valve head 422 is mounted to the inside of upper tube 418 by a plurality of fins 423 which extend radially between the outside of the valve head and the inside of the upper tube. Plate-like fins 423 have a small cross-sectional area so as to minimize their obstruction to fluid flow within the subassembly. Valve head 422 has an upper surface 426 which is configured for snug disposition in valve seat 371 and, in this regard, valve seat and head 371 and 422 are included within the valve means of subassembly 351.

At least two fins 427 extend radially outwardly from the upper end of upper tube 418 and have outer ends which extend into longitudinally extending channels 428 formed in inner surface 358. Fins 427 and channels 428 serve to angularly lock piston element 416 and valve head 422 with upper housing 353 and fins 427 abut upper collar 362 to limit the downward movement of piston element 306 within the upper housing.

An annular cavity 431 is formed on the sides by piston element 416 and upper housing 353 and on the ends by upper collar 362 and piston head 387. Cavity 431 is sealed from the pressurized mud fluid within subassembly 351 by seal rings 366 disposed on the inside of upper collar 362 and piston head 387. Holes or ports 432 extend through upper housing 353 into annular cavity 431 and permit the mud fluid traveling from the mud motor up the bore hole to enter cavity 431.

Upper and lower spacer washers 436 and 437, substantially similar to washers 216 and 217, are disposed about piston element 381 in cavity 431 and are radially sized to fit concentrically within tubular housing 402. Lower washer 437 is threadedly mounted to an annular recess 438 formed in piston head 387 which opens onto upper and inner surfaces 391 and 393 thereof. Washers 436 and 437 have opposite lower and upper surfaces 438 and 439 which abut at all times and have alternate slots and risers, not shown in the drawings but substantially similar to slots and risers 227 and 231, formed thereon. Opposed slots and risers can cooperatively mate in a manner discussed above for causing upper washer 436 to be disposed in a first or lower position within cavity 431. Opposed risers can also abut for causing the upper washer to be disposed in a second or upper position within cavity 431.

A coil spring 442 is disposed within annular cavity 431 and has upper and lower ends which respectively abut annular collar 421 and upper washer 436. Spring 442 serves to bias valve head 422 toward a closed position relative to valve seat 371. Set screws 443 extend through upper tube 418 and upper washer 436 to engage spring 442 and serve to rotatably lock the upper washer with piston element 416. Piston element 416, valve seat 371, spacer washers 436 and 437 and coil spring 442 are included within the signaling means of subassembly 351 and operate in substantially the same manner as discussed above.

In operation and use, drilling subassembly 351 can permit straight bore and directional drilling in substantially the same manner as drilling subassembly 22. The design of subassembly 351 permits a shortening of the drilling subassembly and can be used with upper or outer housings 353 having radially dimensions which approximate those of outer housing 52 of subassembly 22.

Figure 19:
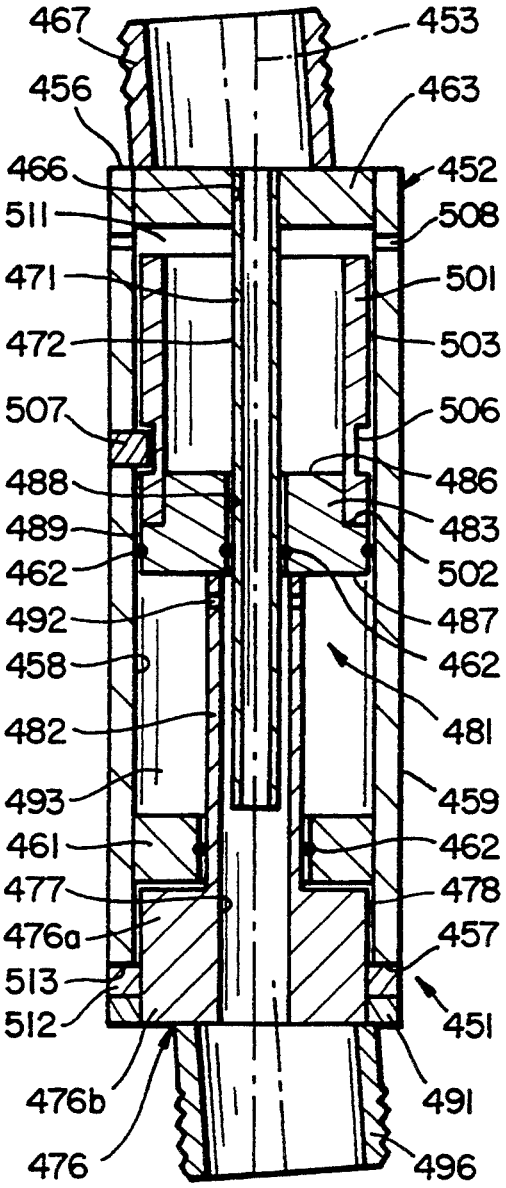
FIG. 19 is a side cross-sectional view of yet another embodiment of the downhole drilling subassembly of the present invention.

In another embodiment of the invention, a streamlined downhole adjustable bend drilling subassembly 451 is provided which does not include the variable relief valve signaling means of the previously described embodiments. Subassembly 451, illustrated in FIG. 19, is similar in many respects to subassembly 351 and includes a tubular upper or outer housing 452 axially centered on longitudinal axis 453 of the subassembly. Upper housing 452 has upper and lower ends 456 and 457 and opposite inner and outer surfaces 458 and 459 which are each circular in cross-section. An annular lower collar 461 is mounted to inner surface 458 in a position spaced upwardly of lower end 457 and a hydraulic seal ring 462 is seated in an annular groove formed in the inner surface of collar 461.

A disk-like cap 463 is mounted to inner surface 458 adjacent upper end 456 of the upper housing and is provided with and centrally disposed bore or opening 466 therein for permitting mud fluid to enter subassembly 451. A threaded upper nipple 467 is mounted to top cap 462 off center longitudinal centerline 453 and at an oblique angle thereto for coupling the subassembly to upper section 37 of drill string 21. An elongate tube 471 having an outer surface 472 is mounted at the upper end thereof to the inside of opening 466 and extends downwardly into upper housing 452 along centerline 453.

A longitudinally extending lower housing 476 is included within subassembly 451 and has upper and lower portions **476*a* and 476*b* and opposite inner and outer surfaces 477 and 478 which are each circular in cross-section. A piston element 481 is rigidly joined to upper portion 476*a* and has a tubular stem 482 which extends upwardly into upper housing 452. An annular piston head 483 having opposite upper and lower parallel surfaces 486 and 487 and inner and outer surfaces 488 and 489 is rigidly connected to the upper end of stem 482. Piston head 483 is axially aligned about centerline 453 and has a hydraulic seal ring 462 seated on inner surface 488 which slidably engages outer surface 472 of elongate tube 471 and another seal ring seated on outer surface 489 which slidably engages inner surface 458 of upper housing 452**.

The slidable engagement of piston element 481 within upper housing 452 permits lower housing 476 to move upwardly and downwardly between a first or upper longitudinal position, where upper portion **476*a* is in concentric engagement with the upper housing, and a second or lower longitudinal position, where the upper and lower portions 476*a* and 476*b* extend downwardly below the upper housing. Lower surface 487 of piston head 483 abuts lower collar 461 to limit downward movement of lower housing 476 at its lower position and an annular stop collar 491 is mounted to outer surface 478 of lower portion 476*b* and abuts lower end 457 of upper housing 452 to limit upward movement of the lower housing at its upper position. A plurality of bleed holes 492 extend through stem 482 and permit pressurized fluid within subassembly 451 to enter annular cavity 493 formed by the stem, outer housing 452, piston head 483 and lower collar 461. The fluid pressure acting on piston head lower surface 487 serves to retain the lower housing within the upper housing in the manner discussed above. A tubular threaded lower nipple 496 is rigidly mounted to the bottom end of lower housing 476 at a distance off center axis 453 equal to the offset distance of upper nipple 467 and at an oblique angle relative axis 453** equal to the oblique inclination angle of the upper nipple.

Rotation means responsive to the raising and lowering of drill string 21 is provided and includes tubular housing 501 rigidly mounted to piston head 483 and extending axially upwardly therefrom within upper housing 452. The piston head is provided with an annular recess 502 which opens onto upper and outer surfaces 486 and 489 for receiving the lower end of housing 452. The tubular housing has an outer surface 503 which is circular in cross-section and provided with a continuous groove 506 formed therein. Groove 506 is substantially identical to continuous groove 126 of subassembly 22 and is configured in a zig-zag pattern around housing 452. A pin 507 is mounted to upper housing 452 and extends through inner surface 458 thereof into groove 506 and serves to rotate lower housing 476 with respect to upper housing 452 during upward and downward travel of the lower housing relative to the upper housing. Holes or ports 508 extend through upper housing 452 into otherwise sealed annular cavity 511 formed by elongate tube 471, upper housing 452, top cap 463 and piston head 483 for permitting fluid from outside the subassembly to enter cavity 511 for the reasons discussed above. Upstanding lugs 512 on stop collar 491 and cooperatively aligned slots 513 provided in lower end 457 of the upper housing rotationally lock housings 452 and 476 when concentrically engaged in an operational position.

In operation and use, directional drilling subassembly 451 can change from a straight bore drilling configuration, illustrated in FIG. 19, to a directional drilling configuration by raising drill string 21 off of and then lowering the drill back onto bore hole bottom 33. Axes 38 and 42 of upper and lower sections 37 and 41 of the drill string intersect on the midpoint of subassembly centerline 453 at all times. This simplified embodiment of the invention does not include the signaling means of the previous embodiments, but the bend angle of subassembly 451 can be nevertheless monitored through keeping track of the up and down change bend cycles.

In view of the foregoing, it can be seen that a new and improved downhole directional drilling subassembly and method have been provided which are an improvement over the prior art. The subassembly makes use of a relatively simple and durable design which minimizes the use of fragile or sophisticated components prone to failure. The subassembly and method changes the mud fluid pressure, easily detectable at the well head, at which fluid flow commences through the subassembly to reflect a change in the bend angle of the subassembly, and does not require any dedicated or special equipment at the well head to change the angle of drilling. The subassembly and method utilize the reliable and reproducible operation of raising the drill string column a short distance off the bottom of the bore hole and then setting the drill string column back down again to change the angle of drilling.

What is claimed is:

1. In a downhole drilling subassembly for use with a pressurized fluid carrying drill string extending from a well head down to a bottom of a bore hole and having upper and lower sections disposed at an angle with respect to each other in the bore hole, an upper subassembly portion adapted to couple to the upper section of the drill string and extending along a subassembly longitudinal axis, a lower subassembly portion adapted to couple to the lower section of the drill string, the lower subassembly portion being carried by the upper subassembly portion and extending along the subassembly longitudinal axis, the upper and lower subassembly portions having respective bores adapted to permit the passage of pressurized fluid therethrough, and means carried by the upper and lower subassembly portions responsive to raising the drill string off the bottom of the bore hole when the fluid in the drill string has been significantly depressurized for rotating the upper and lower subassembly portions with respect to one another in the bore hole between first and second relative angular positions about the subassembly longitudinal axis.

2. The downhole drilling subassembly of claim 1 wherein the upper and lower subassembly portions are coupled to respective upper and lower sections of the drill string at an oblique angle so that relative rotation between the upper and lower subassembly portions changes the angle between the upper and lower sections of the drill string.

3. The downhole drilling subassembly of claim 2 wherein the upper and lower sections having respective upper and lower longitudinal axes, means carried by the upper and lower subassembly portions for causing the upper and lower longitudinal axes of the drill string to intersect on the subassembly longitudinal axis so as to minimize undesirable sideways drilling.

4. The downhole drilling subassembly of claim 1 wherein the lower subassembly portion is slidable along the subassembly longitudinal axis between a first longitudinal position in relative retractive engagement with the upper subassembly portion and a second longitudinal position in relative extension with respect to the upper subassembly portion.

5. The downhole drilling subassembly of claim 4 wherein said upper subassembly portion includes an upper tubular housing and wherein said lower subassembly portion includes a lower tubular housing concentrically carried within the upper tubular housing of the upper subassembly portion when the lower subassembly portion is in its first longitudinal position.

6. The downhole drilling subassembly of claim 5 wherein said rotating means includes a continuous recess free of movable gates extending circumferentially around one of the tubular housings and formed with a side wall extending in a direction diagonal to the subassembly longitudinal axis and a pin carried by the other of the tubular housings and having a portion for travel in the recess whereby the portion of the pin engages the side wall as the lower tubular housing moves between its first and second longitudinal positions so as to cause the upper and lower tubular housings to rotate relative to each other.

7. The downhole drilling subassembly of claim 6 wherein the continuous recess is a groove formed from a plurality of intersecting groove portions extending in directions diagonal to the subassembly longitudinal axis.

8. The downhole drilling subassembly of claim 4 together with hydraulic means coupled to the lower subassembly portion for retaining said subassembly portion in its first longitudinal position in relative retractive engagement with the upper subassembly portion when the pressurized fluid is passing through the subassembly portions.

9. The downhole drilling subassembly of claim 8 wherein said hydraulic means includes a piston member having a lower fluid bearing surface for creating upward hydraulic forces.

10. The downhole drilling subassembly of claim 1 together with signaling means carried by the upper subassembly portion and dependent upon the relative angular position of the upper and lower subassembly portions for adjusting the fluid pressure at which fluid flow commences through the upper and lower subassembly portions upon pressurization of the drill string.

11. The downhole drilling subassembly of claim 10 wherein said signaling means includes valve means provided with a valve seat and a valve head and spring means for exerting a force against the valve head for urging it toward the valve seat and means responsive to the relative angular position of the upper and lower subassembly portions for adjusting the force exerted by the spring means against the valve head.

12. The downhole drilling subassembly of claim 10 wherein said signaling means includes valve means provided with a valve seat and a valve head and means dependent upon the relative angular position of the upper and lower subassembly portions for adjusting the static positions of the valve seat and valve head relative to each other.

13. The downhole drilling subassembly of claim 12 wherein said valve seat and head are movable relative to each other between a closed position, a first open position for permitting the passage of pressurized fluid therethrough and a second open position for permitting high volume fluid flow therethrough, the valve means having first hydraulic means responsive to the pressurized fluid for moving the valve means from the closed position to the first open position and second hydraulic means responsive to the pressurized fluid for moving the valve means from the first open position to the second open position.

14. The downhole drilling subassembly of claim 1 together with means responsive to lowering the drill string back onto the bottom of the bore hole for rotating the upper and lower subassembly portions with respect to one another between second and third relative angular positions about the subassembly longitudinal axis.

15. The downhole drilling subassembly of claim 1 together with means responsive to pressurizing the drill string for rotating the upper and lower subassembly portions with respect to one another between second and third relative angular positions about the subassembly longitudinal axis.

16. In a downhole drilling subassembly for use with a pressurized fluid carrying drill string extending from a well head and having a lower portion down a bore hole, a housing adapted to couple to the lower portion of the drill string, a valve seat carried within the housing and having an opening adapted to permit pressurized fluid to pass therethrough, a piston slidably carried within the housing and having a piston head, a valve head mounted to the piston head for movement between a closed position in engagement with the valve seat to a first open position for permitting fluid to pass through the opening in the valve seat and to a second open position for permitting high volume fluid flow through the opening in the valve seat, and spring means carried by the housing and coupled to the piston for biasing the valve head toward its closed position, the valve head having a cross-sectional surface area sized to permit fluid above a first predetermined pressure to move the valve head to the first open position and the piston head having a cross-sectional area sized to permit fluid above a second predetermined pressure greater than the first predetermined pressure to move the valve head from the first open position to the second open position.

17. The downhole drilling subassembly of claim 16 together with means carried by the housing for adjusting the biasing force of the spring means on the valve head.

18. In a downhole drilling subassembly for use with a pressurized fluid carrying drill string extending from a well head and having a lower portion down a bore hole, a longitudinally-extending housing adapted to couple to the lower portion of the drill string and permit pressurized fluid to travel therethrough, a tubular piston element slidably carried within the housing and movable between first and second longitudinal positions relative to the housing, the tubular piston element having a central bore extending therethrough in which the pressurized fluid can pass and having first and second portions with respective first and second outer transverse dimensions, the first outer dimension being greater than the second outer dimension, and first hydraulic seal means disposed between the housing and the first portion and second hydraulic seal means disposed between the housing and the second portion so that the space between the housing and the tubular piston element bordered longitudinally by the first and second portions of the tubular piston element is hydraulically sealed from the pressurized fluid passing through the housing, the pressurized fluid passing through the housing and the tubular piston element exerting a net longitudinal force on the tubular piston element which causes the tubular piston element to move from its first longitudinal position to its second longitudinal position.

19. The downhole drilling subassembly of claim 18 wherein the housing and the portions of the tubular piston element are circular in cross-section.

20. The downhole drilling subassembly of claim 18 wherein the first and second portions have respective first and second inner transverse dimensions, the first inner dimension being greater than the second inner dimension.

21. The downhole drilling subassembly of claim 18 wherein the housing is provided with at least one opening therein to permit the passage of fluid from the bore hole into the space between the housing and the first and second portions of the tubular piston element.

22. In a downhole drilling subassembly for use with a pressurized fluid carrying drill string extending from a well head down a bore hole and having upper and lower sections in the bore hole, a first tubular housing, first means carried by the first tubular housing adapted to couple the first tubular housing to the upper section of the drill string, a second tubular housing, second means carried by the second tubular housing adapted to couple the second tubular housing to the lower section of the drill string, each of the housings having a generally circular cross-section and extending along a longitudinal axis, the second tubular housing being carried by the first tubular housing and being longitudinally movable relative to the first tubular housing between a first position at least partially retracted within the first tubular housing and a second position at least partially extended from the first tubular housing, a continuous groove free of movable gates provided in one of the tubular housings and extending circumferentially therearound in a zig-zag configuration, the continuous groove being formed with opposed diagonally extending side walls, and a pin carried by the other of the tubular housings and having a portion for travel in the groove, movement of the second tubular housing from its first position to its second position and back to its first position causing the portion of the pin traveling in the groove to engage the side walls so as to cause the second tubular housing to rotate relative to the first tubular housing about the longitudinal axis.

23. The downhole drilling subassembly of claim 22 wherein the continuous groove is formed in the second tubular housing and the pin is carried by the first tubular housing.

24. The downhole subassembly of claim 22 wherein the first means couples the first tubular housing to the upper section of the drill string at an oblique angle and the second means couples the second tubular housing to the lower section of the drill string at an oblique angle.

25. In a downhole drilling subassembly for use with a pressurized fluid carrying drill string extending from a well head down a bore hole and having upper and lower sections disposed at an angle with respect to each other in the bore hole, the upper and lower sections having respective upper and lower longitudinal axes, an upper tubular housing centered on a housing longitudinal axis and adapted to couple to the upper section of the drill string at an oblique angle, a lower tubular housing adapted to couple to the lower section of the drill string at an oblique angle, the lower tubular housing being slidably carried by the upper tubular housing and being centered on the housing longitudinal axis, and means carried by the upper and lower tubular housings and responsive to extending longitudinally the lower tubular housing under the weight of the lower section of the drill string from the upper tubular housing and then retracting longitudinally the lower tubular housing toward the upper tubular housing for rotating the upper and lower tubular housings with respect to one another in the bore hole between first and second relative angular positions so as to change the angle between the upper and lower sections of the drill string, the rotating means including a recess provided in one of the tubular housings and formed with a side wall extending diagonal to the longitudinal axis and a pin carried by the other of the tubular housings and having a portion for travel in the recess whereby the pin engages the side wall as the lower tubular housing is extended from the upper tubular housing so as to cause the upper and lower tubular housings to rotate relative to one another about the housing longitudinal axis.

26. The downhole drilling subassembly of claim 25, together with valve means carried by the upper tubular housing, the valve means including a valve seat and a valve head which are movable relative to each other between a closed position, a first open position for permitting the passage of pressurized fluid therethrough and a second open position for permitting high volume fluid flow therethrough, the valve means having first hydraulic means responsive to the pressurized fluid for moving the valve means from the closed position to the first open position and second hydraulic means responsive to the pressurized fluid for moving the valve means from the first open position to the second open position.

27. A downhole drilling subassembly as in claim 26 together with means carried by the upper and lower tubular housings for causing the upper and lower longitudinal axes of the drill string to intersect on the housing longitudinal axis so as to minimize undesirable sideways drilling.

28. In a downhole drilling subassembly for use with a pressurized fluid carrying drill string extending from a well head down a bore hole and having upper and lower sections disposed at an angle with respect to each other in the bore hole, the upper and lower sections having respective upper and lower longitudinal axes, an upper tubular housing adapted to couple to the upper section of the drill string at an oblique angle and extending along a subassembly longitudinal axis, a lower tubular housing slidably concentrically carried by the upper tubular housing and adapted to couple to the lower section of the drill string at an oblique angle, a tubular element slidably carried within the upper and lower tubular housings, the upper and lower tubular housings and the tubular element having respective bores extending longitudinally therethrough adapted to permit the passage of pressurized fluid, means carried by the upper and lower tubular housings for causing the upper and lower tubular housings to rotate with respect to one another between first and second relative angular positions about the subassembly longitudinal axis as the lower tubular housing is longitudinally extended from and retracted back into the upper tubular housing and means carried by the lower tubular housing and the tubular element dependent upon the relative angular position of the upper and lower tubular housings for adjusting the fluid pressure at which fluid flow commences through the subassembly upon pressurization of the drill string.

29. In a downhole drilling subassembly for use with a pressurized fluid carrying drill string extending from a well head and having a lower portion down a bore hole, a hollow longitudinally-extending housing adapted to couple to the lower portion of the drill string, a tubular element concentrically carried within the housing and spaced inwardly of the housing, the tubular element having first and second spaced-apart portions and a central bore extending between the first and second portions which is adapted to permit the passage of pressurized fluid, a fluid sealing wall joined to the housing and extending inwardly to the first portion of the tubular element, a piston element concentrically carried between the housing and the second portion of the tubular element for slidable movement relative to the housing and the tubular element from a first longitudinal position to a second longitudinal position closer to the fluid sealing wall, first fluid sealing means extending between the housing and the piston element and second fluid sealing means extending between the piston element and the second portion of the tubular element so that the space between the housing and the tubular element bordered longitudinally by the fluid sealing wall and the piston element is sealed from the pressurized fluid within the housing, the piston element having a fluid bearing surface with a transverse area sufficient for causing the pressurized fluid within the housing to move the piston element from its first longitudinal position to its second longitudinal position.

30. The downhole drilling subassembly of claim 29 wherein the tubular element is slidably carried within the housing.

31. In a downhole drilling subassembly for use with a pressurized fluid carrying drill string extending from a well head and having a lower portion down a bore hole, a longitudinally-extending housing adapted to couple to the lower portion of the drill string and permit pressurized fluid to travel therethrough, a tubular piston element carried within the housing and having spaced-apart first and second portions, at least the first portion being movable between first and second longitudinal positions relative to the housing, the tubular piston element having a central bore extending therethrough in which the pressurized fluid can pass and the first and second portions having respective first and second outer transverse dimensions, the first outer dimension being greater than the second outer dimension, and first hydraulic seal means disposed between the housing and the first portion and second hydraulic seal means disposed between the housing and the second portion so that the space between the housing and the tubular piston element bordered longitudinally by the first and second portions of the tubular piston element is hydraulically sealed from the pressurized fluid passing through the housing, the pressurized fluid passing through the housing and the tubular piston element exerting a net longitudinal force on the tubular piston element which causes the first portion to move from its first longitudinal position to its second longitudinal position.

* * * * *